US012352467B2

(12) United States Patent
Kang et al.

(10) Patent No.: US 12,352,467 B2
(45) Date of Patent: Jul. 8, 2025

(54) AIR CONDITIONER AND METHOD FOR CONTROLLING THE SAME

(71) Applicant: SAMSUNG ELECTRONICS CO., LTD., Suwon-si (KR)

(72) Inventors: Myungsoo Kang, Suwon-si (KR); Kyuho Shin, Suwon-si (KR); Jinkook Yoon, Suwon-si (KR); Hyongsoo Noh, Suwon-si (KR); Myungseob Song, Suwon-si (KR); Joonoh Shin, Suwon-si (KR); Kisup Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 320 days.

(21) Appl. No.: 17/994,802

(22) Filed: Nov. 28, 2022

(65) Prior Publication Data

US 2023/0175718 A1 Jun. 8, 2023

Related U.S. Application Data

(63) Continuation of application No. PCT/KR2022/014580, filed on Sep. 28, 2022.

(30) Foreign Application Priority Data

Dec. 6, 2021 (KR) ..... 10-2021-0172824

(51) Int. Cl.
*F24F 8/20* (2021.01)
*F24F 8/192* (2021.01)
*F24F 110/65* (2018.01)

(52) U.S. Cl.
CPC ..... *F24F 8/194* (2021.01); *F24F 8/20* (2021.01); *F24F 2110/65* (2018.01)

(58) Field of Classification Search
CPC ..... F24F 8/194; F24F 8/20
See application file for complete search history.

(56) References Cited

U.S. PATENT DOCUMENTS 7,312,973 B2 12/2007 Sekoguchi et al.
2008/0105567 A1* 5/2008 Okayama ..... G01N 15/0656 204/431

(Continued)

FOREIGN PATENT DOCUMENTS

CN 1791467 B 11/2010
CN 112742151 B 10/2023

(Continued)

OTHER PUBLICATIONS

Supplementary European Search Report dated Sep. 24, 2024 issued in European Application No. EP 22 90 4413.

*Primary Examiner* — Robert A Hopkins
(74) *Attorney, Agent, or Firm* — STAAS & HALSEY LLP

(57) ABSTRACT

An air conditioner includes a dust collection sheet including a first electrode and a second electrode separated from the first electrode and facing the first electrode, and to collect particles in air, a power supplier electrically connected to the first and second electrodes, and a controller configured to control the power supplier to apply a direct current (DC) voltage to the first electrode to perform a dust collecting operation, determine to perform at least one of a first sterilizing operation at a preset first temperature for a first period of time and a second sterilizing operation at a second temperature higher than the first temperature for a second period of time shorter than the first period of time, and control the power supplier to apply an alternate current (AC) voltage to the first electrode and the second electrode for the first sterilizing operation or the second sterilizing operation.

20 Claims, 21 Drawing Sheets

(56) References Cited

U.S. PATENT DOCUMENTS

| | | | |
|---|---|---|---|
| 2019/0143339 | A1 | 5/2019 | Hosomi |
| 2023/0097963 | A1 | 3/2023 | Kang et al. |

FOREIGN PATENT DOCUMENTS

| | | | | |
|---|---|---|---|---|
| JP | 11-304252 | | | 11/1999 |
| JP | 2000-354788 | | | 12/2000 |
| JP | 2001-149938 | | | 6/2001 |
| JP | 3242637 | | | 12/2001 |
| JP | 2002-25748 | | | 1/2002 |
| JP | 2002-189017 | | | 7/2002 |
| JP | 2004-87493 | | | 3/2004 |
| JP | 3797045 | | | 7/2006 |
| JP | 2019205989 | A | * | 12/2019 |
| JP | 2020-49395 | | | 4/2020 |
| KR | 10-0566851 | | | 4/2006 |
| KR | 10-2018-0101844 | | | 9/2018 |
| KR | 10-2013031 | | | 8/2019 |
| KR | 10-2243748 | | | 4/2021 |
| KR | 10-2023-0043449 | | | 3/2023 |
| WO | WO 2023/048371 | A1 | | 3/2023 |

* cited by examiner

AIR CONDITIONER AND METHOD FOR CONTROLLING THE SAME

CROSS-REFERENCE TO RELATED APPLICATION(S)

This application a continuation application, under 35 U.S.C. § 111(a), of International Application No. PCT/KR2022/014580, filed Sep. 28, 2022, which is based on claims priority under 35 U.S.C. § 119 to Korean Patent Application No. 10-2021-0172824, filed on Dec. 6, 2021 in the Korean Intellectual Property Office, the disclosures of which are incorporated by reference herein in their entireties.

BACKGROUND

1. Field

The disclosure relates to an air conditioner capable of sterilizing an electric dust collector that collects particles in the air.

2. Description of Related Art

High concentration aerosol may cause health problems to people in closed space such as a house, a room, a shopping mall, a factory, an office, etc. Such aerosol may come from smoking, cooking, cleaning, welding, grinding, etc., in a restricted space. An air purifier or an air conditioner having an air purification function may include an electric dust collector able to collect the aerosol.

A charging unit of the electric dust collector may charge particles in the air. A dust collection unit of the electric dust collector may be made up of a high-voltage electrode and a low-voltage electrode to collect charged particles in the air. The particles collected on the electrodes may include harmful materials such as bacteria, viruses and allergens. A problem may arise that the harmful materials may be multiplied on the electrodes and re-spread indoors.

SUMMARY

According to an embodiment, an air conditioner may include a dust collection sheet to collect particles in air passing through thereof, the dust collection sheet including a first electrode and a second electrode separated from the first electrode and facing the first electrode; a power supplier may be electrically connected to the first electrode and the second electrode; and a controller may be configured to control the power supplier, and the controller may be configured to control the power supplier to apply a direct current (DC) voltage to the first electrode to perform a dust collecting operation to collect the particles in the air, determine to perform at least one of a first sterilizing operation to heat the first electrode and the second electrode at a preset first temperature for a first period of time and a second sterilizing operation to heat the first electrode and the second electrode at a second temperature which is higher than the first temperature for a second period of time which is shorter than the first period of time, and in response to the determining, control the power supplier to apply an alternate current (AC) voltage to the first electrode and the second electrode for the first sterilizing operation or the second sterilizing operation.

The air conditioner may further include a gas sensor configured to measure a degree of contamination of the air having passed through the dust collection sheet, and the controller may further configured to determine whether to perform the second sterilizing operation based on the measured degree of contamination of the air.

The controller may further configured to determine to sequentially perform the first sterilizing operation and the second sterilizing operation based on the measured degree of contamination of the air being equal to or greater than a preset reference degree of contamination.

The controller may count accumulated performance hours of the dust collecting operation, and may further configured to determine to perform the second sterilizing operation based on the accumulated performance hours reaching preset reference hours.

The controller may further configured to reset the accumulated performance hours of the dust collecting operation based on performance of the second sterilizing operation.

The controller may further configured to determine to perform the second sterilizing operation after performing the first sterilizing operation based on the accumulated performance hours of the dust collecting operation reaching preset reference hours.

The air conditioner may further include an electrode temperature sensor configured to measure a temperature of at least one of the first electrode and the second electrode, and the controller may be further configured to control the power supplier to stop applying AC voltage to the first electrode and the second electrode based on the measured temperature reaching a first limit temperature for the first sterilizing operation or a second limit temperature for the second sterilizing operation.

The electrode temperature sensor may include at least one of a first electrode temperature sensor configured to measure a surface temperature of the first electrode and a second electrode temperature sensor configured to measure a surface temperature of the second electrode.

The controller may be further configure to control the power supplier to apply a first AC voltage having an effective value, which is smaller than a magnitude of the DC voltage, to the first electrode and the second electrode in the first sterilizing operation, and control the power supplier to apply a second AC voltage, having an effective value which is smaller than the magnitude of the DC voltage but higher than the first AC voltage, to the first electrode and the second electrode in the second sterilizing operation.

The dust collection sheet may include a first power connector connected to an end of the first electrode and to which the DC voltage is applied; a second power connector connected to an end of the second electrode and grounded; a third power connector connected to an other end of the second electrode and to which a first AC voltage to heat the second electrode at the first temperature or a second AC voltage to heat the second electrode at the second temperature is applied; and a fourth power connector connected to an other end of the first electrode and to which a first AC voltage to heat the first electrode at the first temperature or a second AC voltage to heat the first electrode at the second temperature is applied.

The first power connector may be on one side of the dust collection sheet in a second direction which is perpendicular to a first direction which is a direction of length of the first electrode, the second power connector may be on the other side of the dust collection sheet in the second direction, the third power connector may be to be adjacent to the first power connector in the second direction, and the fourth power connector may be to be adjacent to the second power connector in the second direction.

According to an embodiment, a method of controlling an air conditioner including a dust collection sheet including a first electrode and a second electrode separated from the first electrode and facing the first electrode may include applying a DC voltage to the first electrode for a dust collecting operation to collect particles in air passing through the dust collection sheet; determining to perform at least one of a first sterilizing operation to heat the first electrode and the second electrode at a preset first temperature for a first period of time and a second sterilizing operation to heat the first electrode and the second electrode at a second temperature which is higher than the first temperature for a second period of time which is shorter than the first period of time; and in response to the determining, applying an AC voltage to the first electrode and the second electrode for the first sterilizing operation or the second sterilizing operation.

The determining may further include determining whether to perform the second sterilizing operation based on a degree of contamination of the air having passed the dust collection sheet which is measured by a gas sensor.

The determining may further include determining to perform the first sterilizing operation based on the measured degree of contamination of the air being smaller than a preset reference degree of contamination.

The determining may further include determining to sequentially perform the first sterilizing operation and the second sterilizing operation based on the measured degree of contamination of the air being equal to or greater than a preset reference degree of contamination.

The determining may further include counting accumulated performance hours of the dust collecting operation, and determining to perform the second sterilizing operation based on the accumulated performance hours reaching preset reference hours.

The accumulated performance hours of the dust collecting operation may be reset based on a performance of the second sterilizing operation.

The determining may include counting accumulated performance hours of the dust collecting operation; and determining to perform the second sterilizing operation after performing the first sterilizing operation based on the accumulated performance hours reaching a preset reference time.

The method of controlling the air conditioner may further include measuring a temperature of at least one of the first electrode and the second electrode.

The method of controlling the air conditioner may include stopping the applying of AC voltage to the first electrode and the second electrode based on the measured temperature reaching a first limit temperature for the first sterilizing operation or a second limit temperature for the second sterilizing operation.

The applying of the AC voltage may include applying a first AC voltage having an effective value, which is smaller than a magnitude of the DC voltage, to the first electrode and the second electrode in the first sterilizing operation, and applying a second AC voltage, having an effective value which is smaller than the magnitude of the DC voltage but higher than the first AC voltage, to the first electrode and the second electrode in the second sterilizing operation.

DETAILED DESCRIPTION

Figure 1:
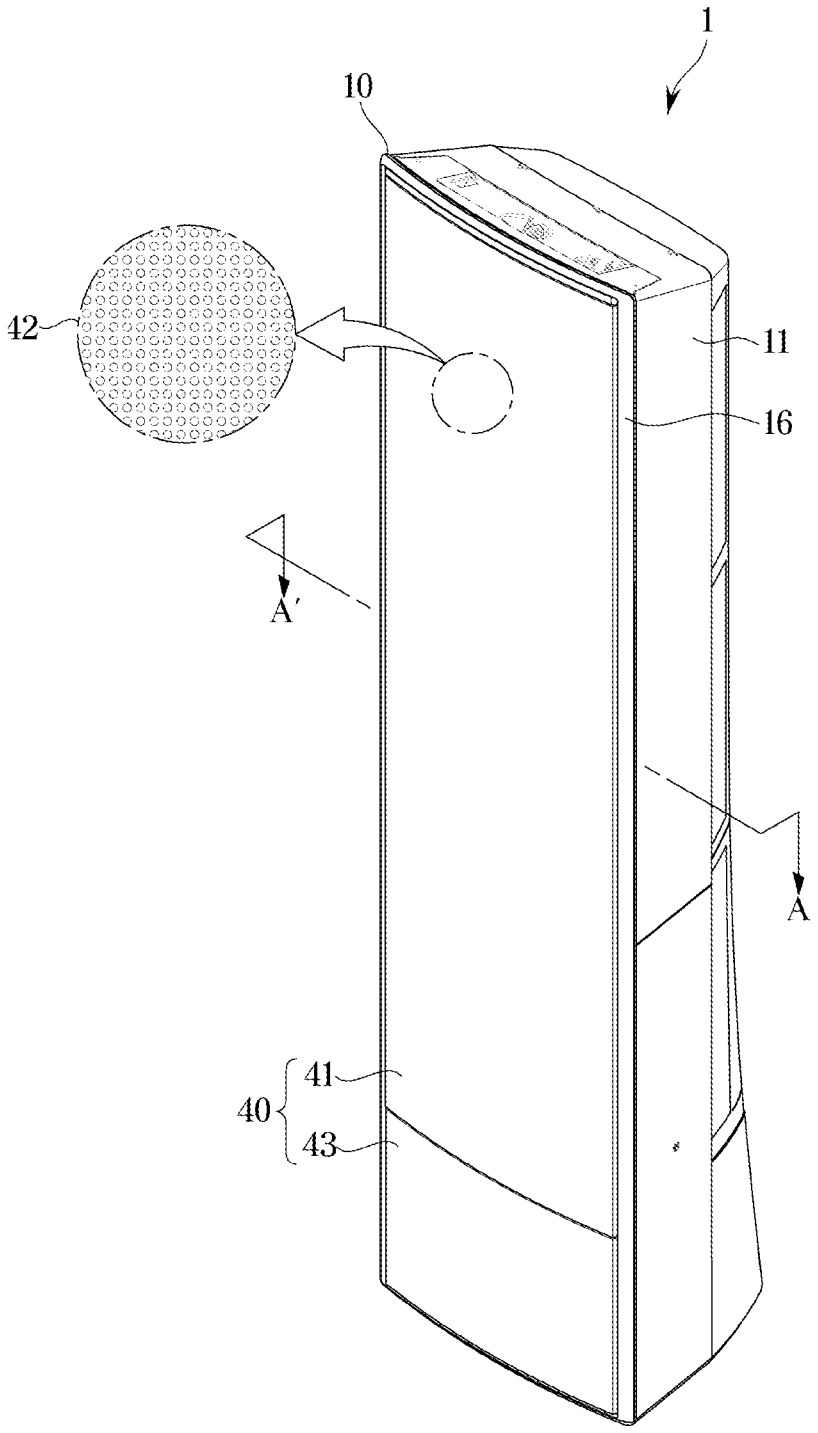
FIG. 1 is an exterior view of an air conditioner, according to an embodiment.

Embodiments and features as described and illustrated in the disclosure are merely examples, and there may be various modifications replacing the embodiments and drawings at the time of filing this application. Throughout the drawings, like reference numerals refer to like parts or components.

The terminology used herein is for the purpose of describing particular embodiments only and is not intended to limit the present disclosure. It is to be understood that the singular forms "a," "'an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

Furthermore, the terms, such as "~ part", "~ block", "~ member", "~ module", etc., may refer to a unit of handling at least one function or operation. For example, the terms may refer to at least one process handled by hardware such as field-programmable gate array (FPGA)/application specific integrated circuit (ASIC), etc., software stored in a memory, or at least one processor.

Reference numerals used for method steps are just used to identify the respective steps, but not to limit an order of the steps. Thus, unless the context clearly dictates otherwise, the written order may also be practiced otherwise.

The terms "forward (or front)", "rearward (or behind)", "left", and "right" as herein used are defined with respect to the drawings, but the terms may not restrict the shape and position of the respective components.

In the following description, as for a positive electrode and a negative electrode, the positive electrode refers to one having a high potential level and the negative electrode refers to one having a low potential level based on a potential difference between the two electrodes.

Reference will now be made in detail to embodiments of the disclosure, which are illustrated in the accompanying drawings.

The disclosure provides an air conditioner and method for controlling the same capable of sterilizing electrodes of a dust collection sheet which constitutes an electric dust collector.

An air conditioner and method for controlling the same as disclosed herein may automatically perform a sterilizing operation to sterilize electrodes of a dust collection sheet included in an electric dust collector, thereby keeping the electric dust collector clean.

An air conditioner and method for controlling the same as disclosed herein may selectively perform at least one sterilizing operation according to a preset condition, thereby improving cleanliness of an electric dust collector.

Figure 2:
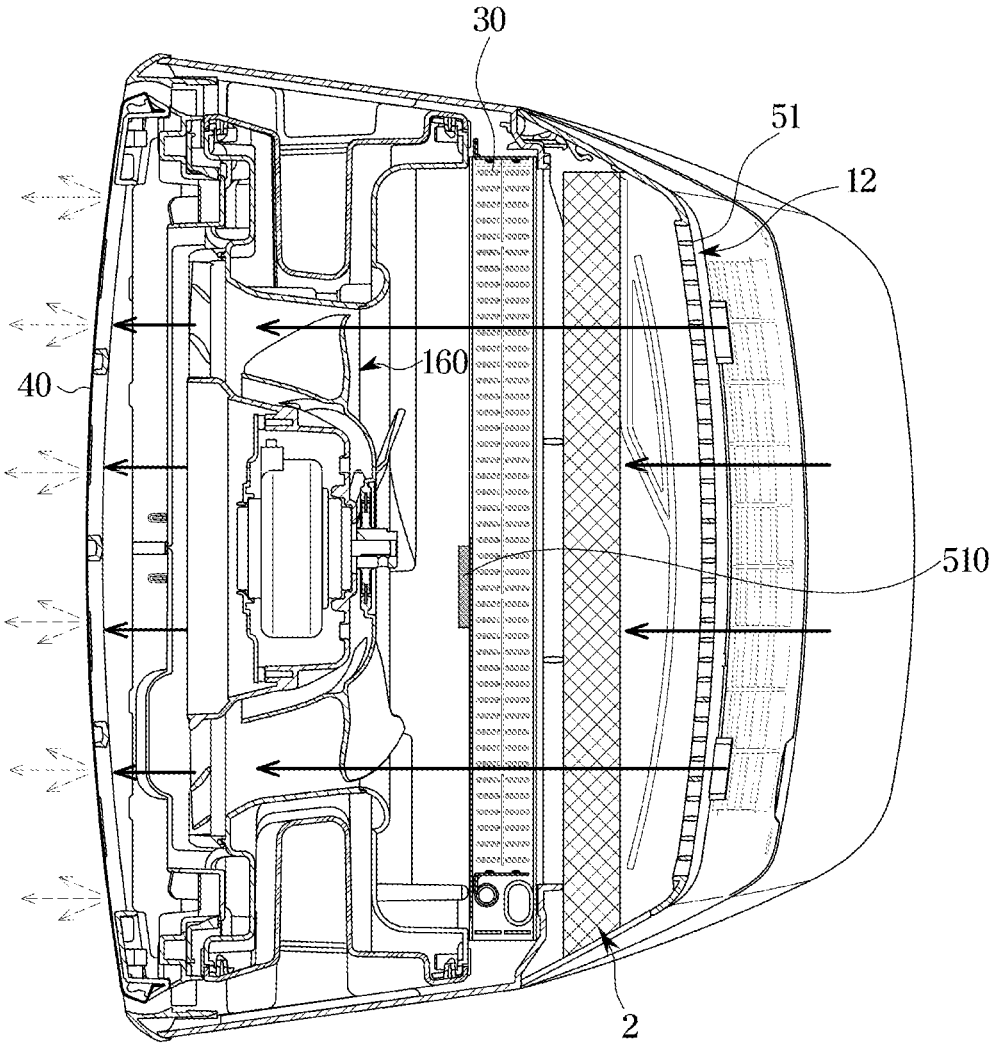
FIG. 2 is a cross-sectional view of an air conditioner, according to an embodiment.

FIG. 1 is an exterior view of an air conditioner, according to an embodiment. FIG. 2 is a cross-sectional view of an air conditioner, according to an embodiment.

Referring to FIGS. 1 and 2, a housing 10 of an air conditioner 1 may include a body case 11 and a front panel 40 covering the front of the body case 11. An inlet 12 through which air is brought in may be arranged in the back of the housing 10. The body case 11 may be covered by a frame 16 and the front panel 40. The front panel 40 may be coupled to the housing 10 by the frame 16.

The front panel 40 may include a discharging area 41 including a plurality of holes 42, and a blocking area 43 where the plurality of holes 42 are not formed. The plurality of holes 42 may penetrate the front panel 40. The plurality of holes 42 may be uniformly distributed in the entire area of the front panel 40. Air may be discharged out of the housing 10 through the plurality of holes 42. As no hole is formed in the blocking area 43, air may not pass through the blocking area 43.

The inlet 12 formed at the body case 11 may penetrate the rear surface of the body case 11. Outside air may be brought into the housing 10 through the inlet 12. There may be at least one inlet 12 or a plurality of inlets 12 depending on the design. The inlet 12 may have the shape of a rectangle. The inlet 12 may be formed in various shapes depending on the design.

The air conditioner 1 may include a sucking grill 51 coupled to a portion in which the inlet 12 of the body case 11 is formed. The sucking grill 51 may be provided to prevent foreign materials from being brought in through the inlet 12. For this, the sucking grill 51 may include a plurality of slits or holes. The sucking grill 51 may be arranged to cover the inlet 12.

A blower fan 160 and an electric dust collector 2 may be arranged in the housing 10. Operation of the blower fan 160 may bring air into the air conditioner 1, and the air may pass the electric dust collector 2 and may then be discharged back to the outside. There may be at least one blower fan 160. Depending on the design, a various number of blower fans 160 may be provided. Although the blower fan 160 is illustrated as being arranged downstream of the electric dust collector 2, the blower fan 160 may be arranged upstream of the electric dust collector 2.

Further, the air conditioner 1 may include a heat exchanger 30 that exchanges heat with the air brought into the housing 10. The heat exchanger 30 may be arranged to be adjacent to the electric dust collector 2. For example, the heat exchanger 30 may be arranged downstream of the electric dust collector 2. The air conditioner 1 including the heat exchanger 30 may be connected to an outdoor unit (not shown) including a compressor. In the housing 10, a driving circuit and/or a control circuit required to operate the air conditioner 1 may also be arranged.

The air conditioner 1 may perform an air purifying function. Throughout the specification, the air conditioner 1 is defined to include an air purifier. The heat exchanger 30 may be omitted from the constituents of the air conditioner 1.

Figure 3:
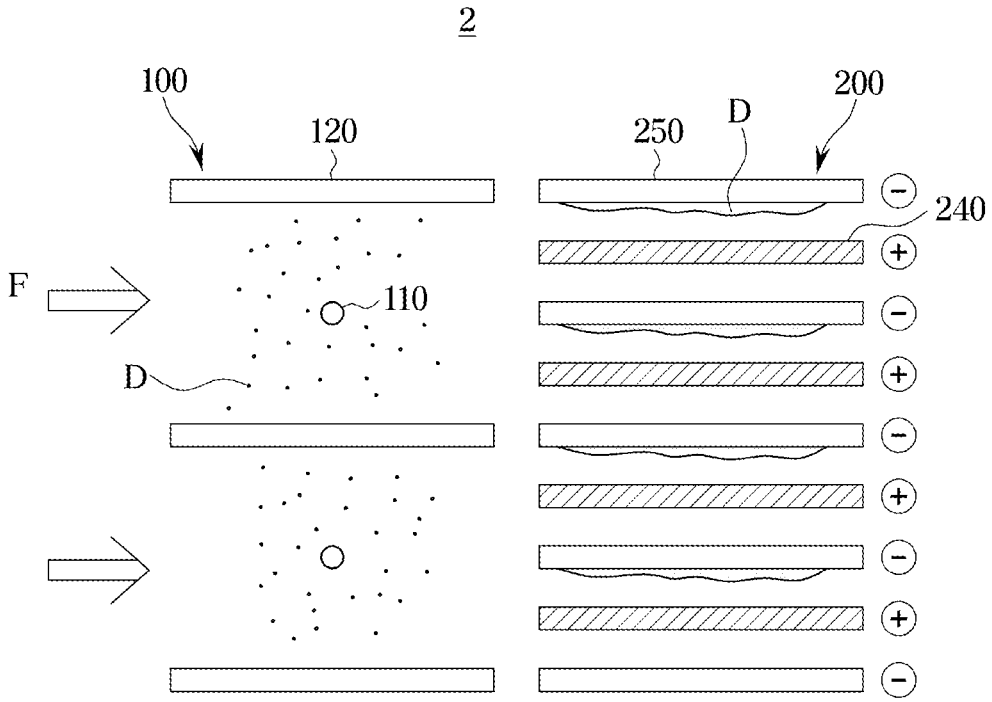
FIG. 3 is a conceptual diagram of an electric dust collector, according to an embodiment.
Figure 4:
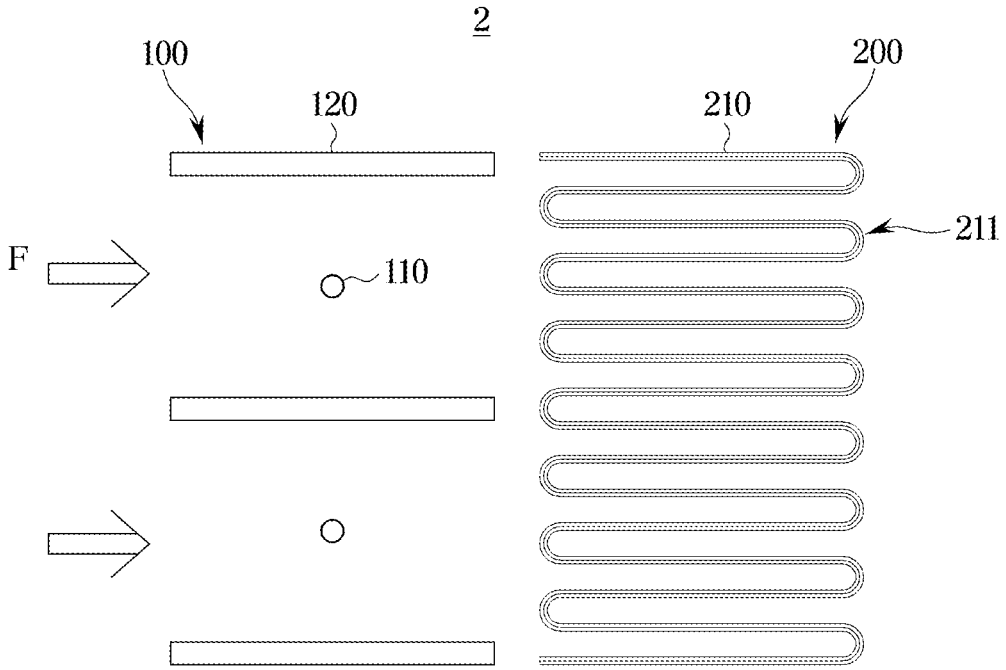
FIG. 4 schematically illustrates an electric dust collector, according to an embodiment.

FIG. 3 is a conceptual diagram of an electric dust collector, according to an embodiment. FIG. 4 schematically illustrates an electric dust collector, according to an embodiment.

Referring to FIGS. 3 and 4, the electric dust collector 2 includes a charging unit 100 and a dust collection unit 200. The charging unit 100 is a component for charging particles D in the air, such as dust, and includes a plurality of discharging electrodes 110 and a plurality of matching electrodes 120. The discharging electrode 110 is arranged between a pair of matching electrodes 120. When a certain voltage is applied to the discharging electrode 110 and the matching electrodes 120, a corona discharge may be caused between one discharging electrode 110 and a pair of the matching electrodes 120, and the particles D in the air, which are passing through the charging unit 100, may be charged.

The discharging electrode 110 may be formed as a wire electrode. For example, the discharging electrode 110 may use a tungsten wire. The matching electrode 120 may be formed in the shape of a flat panel and may be formed of a conductive metal plate. For example, the matching electrode 120 may be formed of an aluminum plate.

The charging unit 100 may representatively have a wire-plate structure that uses high voltage discharge, but may include various means to charge the particles D to a specific polarity in addition to a discharge using a carbon brush electrode or a needle-type electrode.

The dust collection unit 200 may collect the particles D charged by the charging unit 100. The dust collection unit 200 includes a dust collection sheet 210 of a shape in which a piece of sheet is successively bent.

The dust collection sheet 210 includes a plurality of bending parts 211 formed by successively bending the single piece of the dust collection sheet 210 in zigzags. For example, as shown in FIG. 4, the dust collection sheet 210 may have one side shaped like a rectangle with a vertical length longer than a horizontal width, and form the plurality of bending parts 211 by being successively bent in zigzags in the vertical direction. The shape of the dust collection sheet 210 is not, however, limited to the illustrated shape, and may have a horizontal length longer than a vertical length.

The dust collection unit 200 may be arranged such that the plurality of bending parts 211 come between a pair of the matching electrodes 120 of the charging unit 100. For example, the dust collection unit 200 may be structured so that 10 bending parts 211 are placed between a pair of the matching electrodes 120. With this structure, the charged particles D brought into the dust collection unit 200 may be effectively adhered to the dust collection unit 200. The structure of the dust collection unit 200 will be described later in detail.

Figure 5:
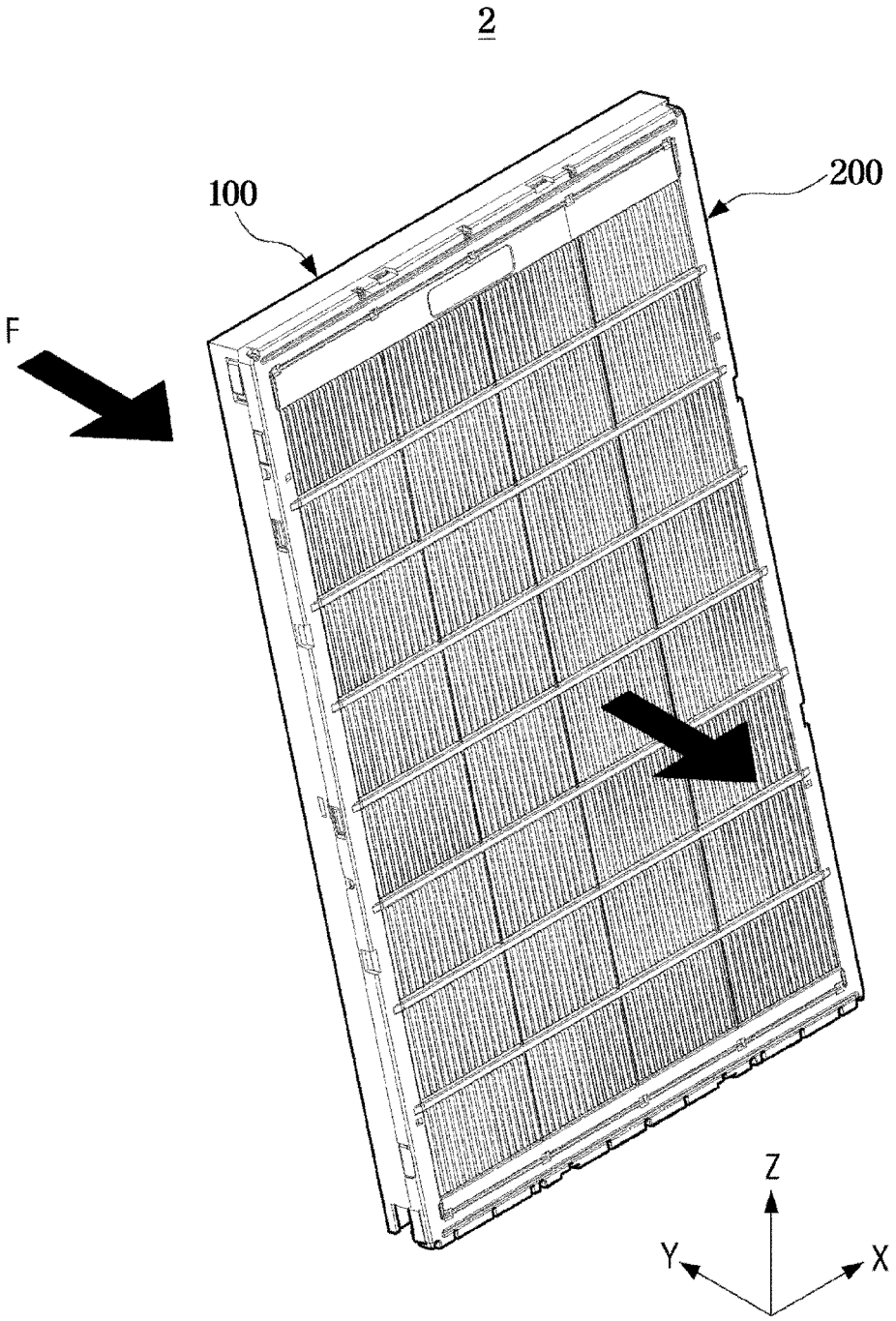
FIG. 5 is a perspective view of an electric dust collector, according to an embodiment.
Figure 6:
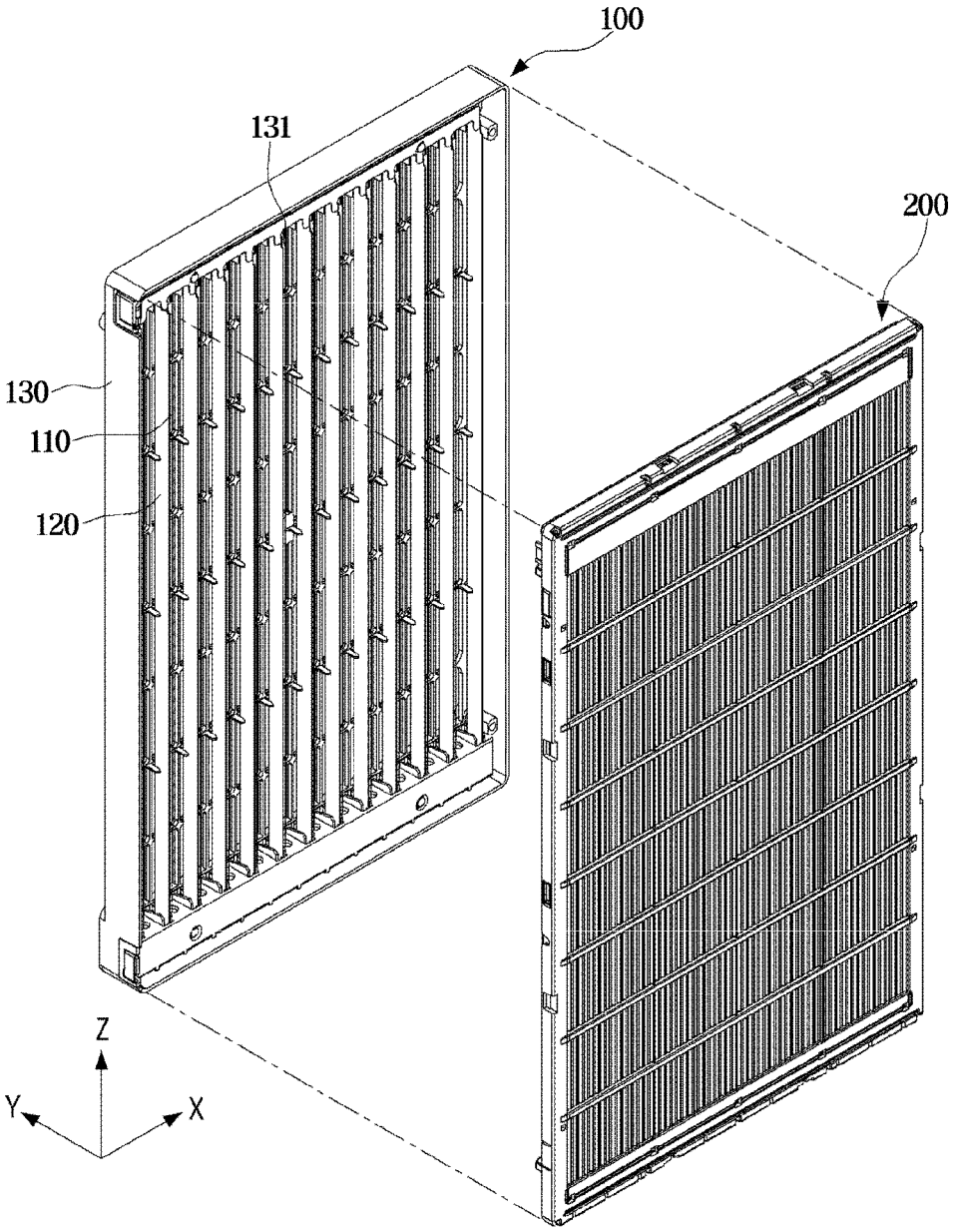
FIG. 6 is an exploded perspective view of the electric dust collector shown in FIG. 5.

FIG. 5 is a perspective view of an electric dust collector, according to an embodiment. FIG. 6 is an exploded perspective view of the electric dust collector shown in FIG. 5.

Referring to FIGS. 5 and 6, the electric dust collector 2 includes the charging unit 100 and the dust collection unit 200 oppositely coupled to the charging unit 100. Air passes through the charging unit 100 and the dust collection unit 200 sequentially in direction F, and accordingly, the particles D in the air may be collected by the dust collection unit 200.

The charging unit 100 includes the plurality of discharging electrodes 110 and the plurality of matching electrodes 120 each arranged between the plurality of discharging electrodes 110, and includes a charging cover 130 supporting the plurality of discharging electrodes 110 and the plurality of matching electrodes 120.

The plurality of discharging electrodes 110 and the plurality of matching electrodes 120 may have the shape that extends in the direction of length (direction Z) of the charging cover 130 inside the charging cover 130, and are alternately arranged in parallel in the direction of width (direction X) of the charging cover 130.

The plurality of discharging electrodes 110 may be metal wires, e.g., tungsten wires, and the plurality of matching electrodes 120 may be comprised of plates of metals such as aluminum, which are formed to extend in the direction of length of the plurality of discharging electrodes 110.

When a high voltage is applied to the discharging electrode 110, particles contained in the air may be charged to have positive (+) polarity or negative (−) polarity through corona discharge of the discharging electrode 110 and the matching electrode 120. In the following description, a case that particles in the air, which are passing the charging unit 110, are charged to have the positive (+) polarity when positive (+) power is applied to the discharging electrode 110 will be taken as an example.

The charging cover 130 may have the shape of a frame that fixes both ends of the plurality of discharging electrodes 110 and the plurality of matching electrodes 120, and includes a plurality of sucking ports 131 formed into a lattice inside. Outside air may be brought in through the plurality of sucking ports 131 of the charging cover 130. Particles contained in the air brought in may be charged through the corona discharge between the plurality of discharging electrodes 110 and the plurality of matching electrodes 120, and may be moved to the dust collection unit 200 arranged downstream of the charging unit 100.

Figure 7:
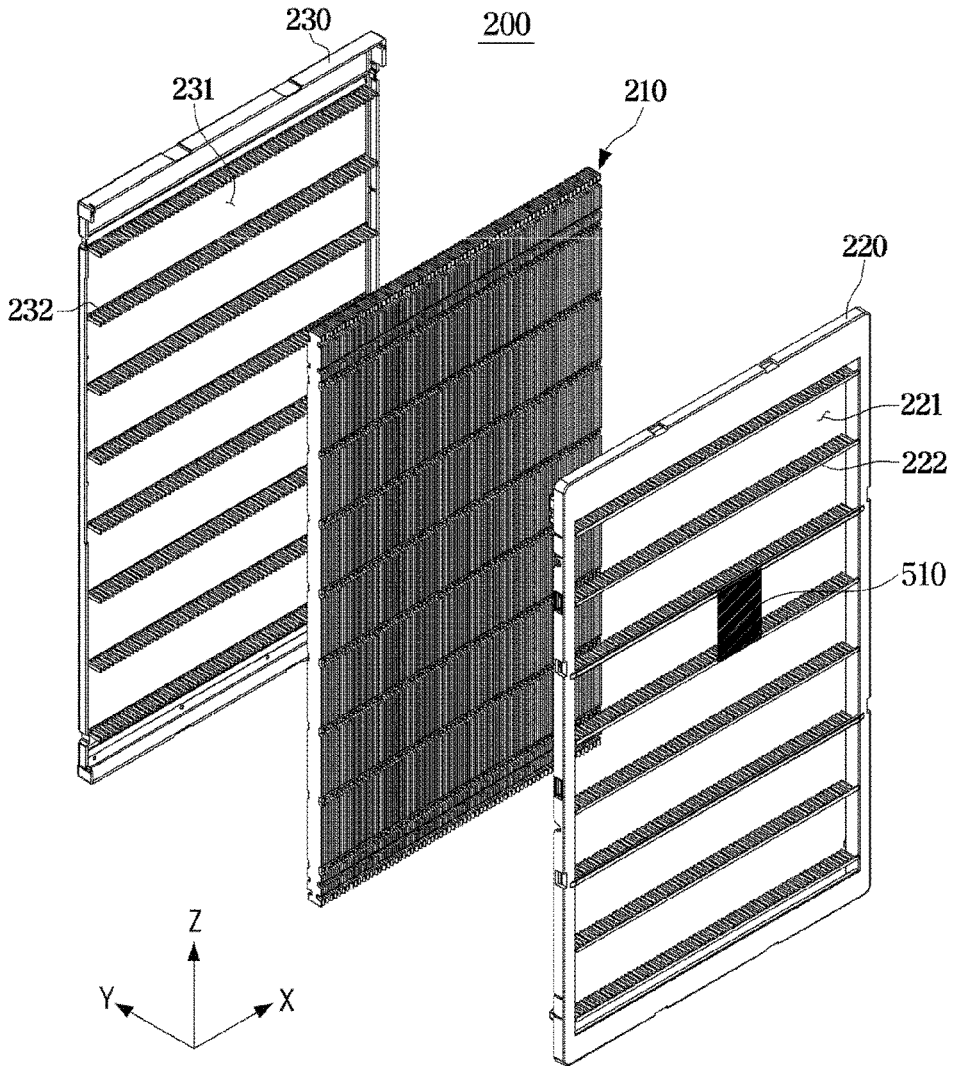
FIG. 7 is an exploded perspective view of a dust collection unit shown in FIG. 6.

FIG. 7 is an exploded perspective view of a dust collection unit shown in FIG. 6.

Referring to FIG. 7, the dust collection unit 200 includes the dust collection sheet 210 having the plurality of bending parts 211 formed, and a first cover 220 and a second cover 230 for covering the dust collection sheet 210. The first cover 220 and the second cover 230 may have the shape of a frame that encloses edges of the dust collection sheet 210, and have a first opening 221 and a second opening 231 formed inside for the air that has passed the charging unit 100 to pass the dust collection sheet 210.

As the dust collection sheet 210 is formed in the shape in which the single piece of the dust collection sheet 210 is bent in zigzags to have the plurality of bending parts 211, the dust collection sheet 210 may further include a plurality of supporting members 222 and 232 formed inside the first cover 220 and the second cover 230 for supporting the dust collection sheet 210. The plurality of supporting members 222 and 232 may be arranged across the first opening 221 of the first cover 220 and the second opening 231 of the second cover 230 at regular intervals, and may stably support the dust collection sheet 210.

Furthermore, on one side of the dust collection unit 200, a gas sensor 510 may be arranged. For example, the gas sensor 510 may be arranged on the first cover 220. The gas sensor 510 may measure a degree of contamination of the air that has passed the dust collection sheet 210. The gas sensor 510 may transmit an electric signal corresponding to the measured degree of contamination of the air to a controller 400, which will be described later. The position of the gas sensor 510 is not limited to what is shown, and may be changed depending on the design. For example, the gas sensor 510 may be arranged downstream of the heat exchanger 30.

Figure 8:
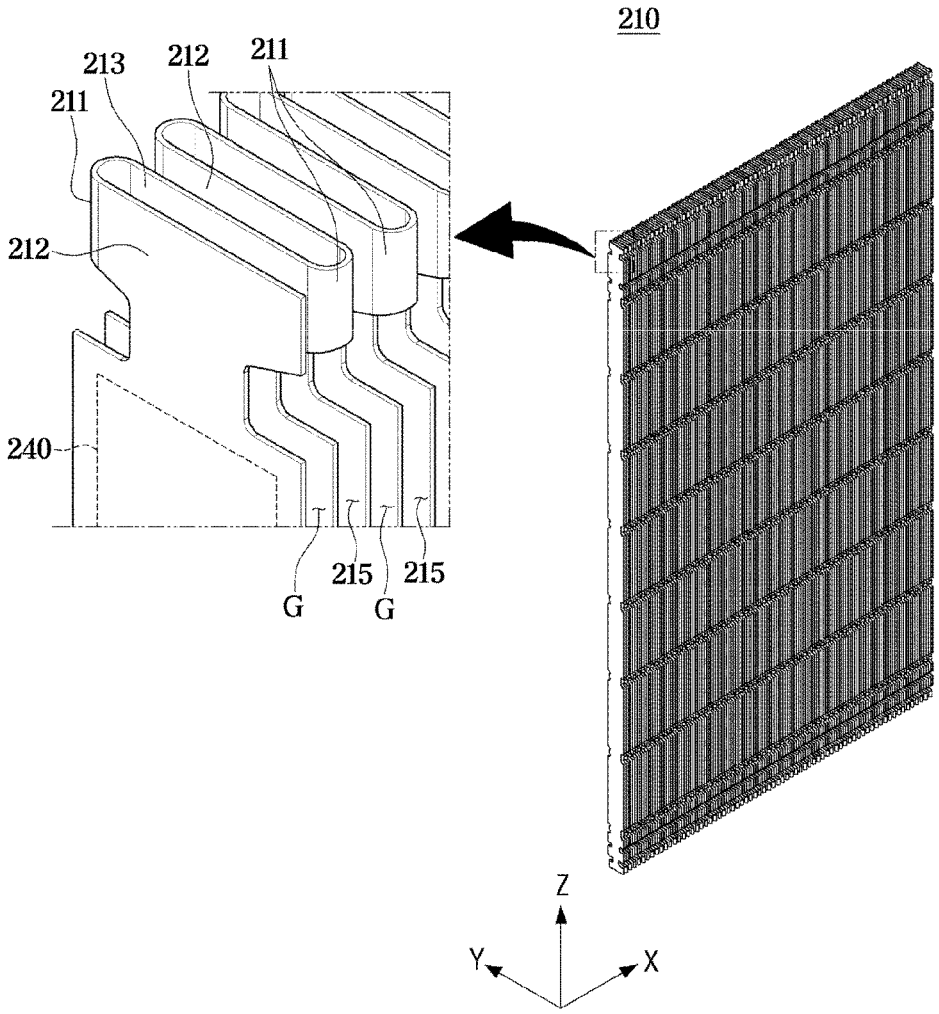
FIG. 8 is an enlarged perspective view of part of a dust collection sheet shown in FIG. 7.
Figure 9:
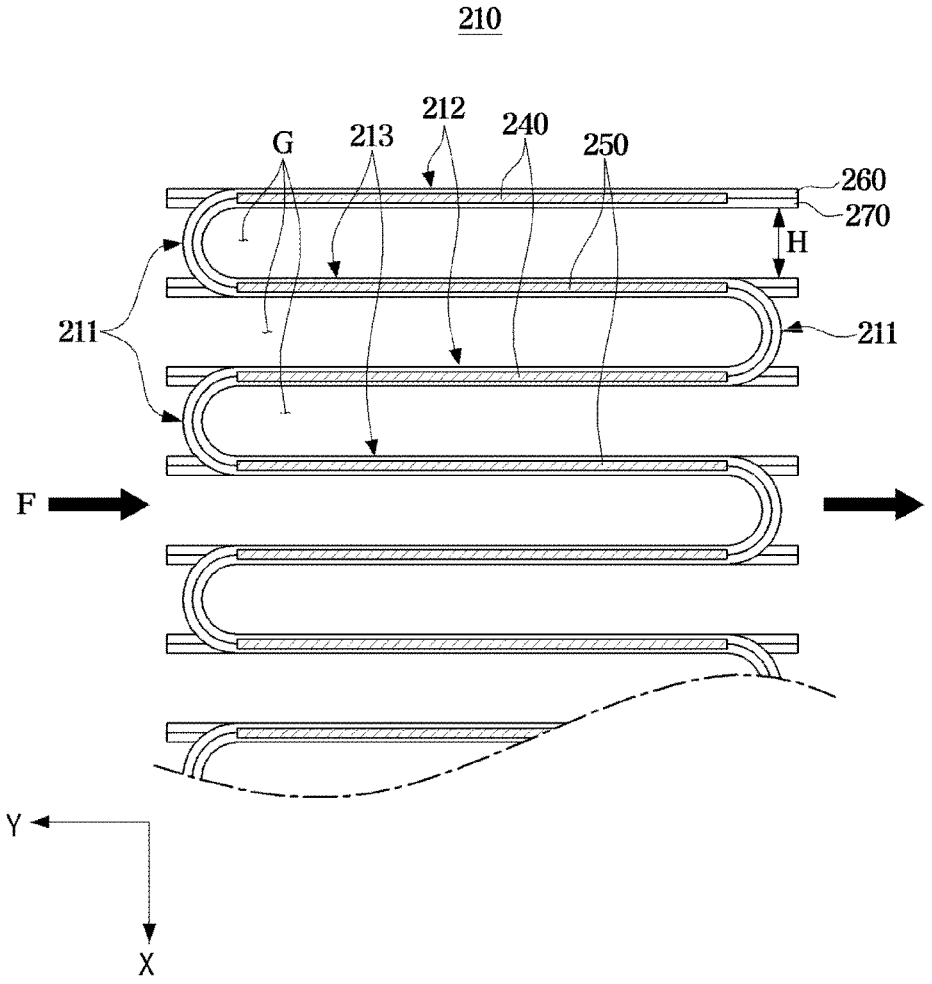
FIG. 9 is a side cross-sectional view of the dust collection sheet shown in FIG. 8.

FIG. 8 is an enlarged perspective view of part of the dust collection sheet shown in FIG. 7. FIG. 9 is a side cross-sectional view of the dust collection sheet shown in FIG. 8.

In FIGS. 8 and 9, a detailed structure of the dust collection sheet 210 bent in zigzags is described. The dust collection sheet 210 may have the shape bent in zigzags in the horizontal direction (direction X). Accordingly, the plurality of bending parts 211 may be formed. The horizontal length (in the direction X) of the dust collection sheet 210 in an unfolded state before being bent may be longer than the vertical length (in the direction Z). The bent dust collection sheet 210 may have the shape of a rectangle.

Depending on the shape of the electric dust collector 2, the shape of the dust collection sheet 210 before being bent may be changed and the bending direction of the dust collection sheet 210 in the unfolded state before being bent may be variously changed as well. The horizontal direction, vertical direction, width direction or length direction of the dust collection sheet 210 is a concept relatively defined based on a direction of view, and may be safely changed variously depending on a criterion.

The dust collection sheet 210 includes plurality of first electrodes 240 and a plurality of second electrodes 250 alternately arranged by the bending. The dust collection sheet 210 may form the plurality of bending parts 211 by bending the flat dust collection sheet 210 made up of a piece of sheet in zigzags. The dust collection sheet 210 includes a first sheet 260 with the plurality of first electrodes 240 and the plurality of second electrodes 250 alternately arranged, and a second sheet 270 laminated on one side of the first sheet 260. The first sheet 260 and the second sheet 270 will be described later.

The plurality of bending parts 211 are formed by bending the dust collection sheet 210 in zigzags such that the plurality of first electrodes 240 and the plurality of second electrodes 250 face each other. The dust collection sheet 210 includes a plurality of planes 212 and 213 arranged at regular intervals to face each other by the bending, and the plurality of bending parts 211 are each placed between two opposite planes 212 and 213 of the plurality of planes 212 and 213 to connect the two planes 212 and 213.

A pair of planes 212 and 213 facing each other may be referred to as a first plane 212 and a second plane 213, and in the dust collection sheet 210, the plurality of first planes 212 and the plurality of second planes 213 are alternately and successively arranged in parallel and the bending parts 211 connecting the first planes 212 and the second planes 213 are formed in zigzags in opposite directions as the dust collection sheet 210 is bent in zigzags.

As the first electrode 240 is arranged on the first plane 212 and the second electrode 250 is arranged on the second plane 213, the plurality of first electrodes 240 and the plurality of second electrodes 250 alternately arranged in the dust collection sheet 210 may be arranged to face each other by the plurality of bending parts 211. The first electrode 240 and the second electrode 250 may be formed to elongate in the direction Z of the dust collection sheet 210.

The bending parts 211 may have a curved shape to form a curved plane between the first plane 201 and the second plane 202. Alternatively, the bending parts 211 may have the shape of a plane vertically bent from the first plane 212 and the second plane 213, and may have the shape of edges formed by straightly folding the dust collection sheet 210 between the first plane 212 and the second plane 213.

The plurality of bending parts 211 of the dust collection sheet 210 may be respectively formed between the plurality of first electrodes 240 and the plurality of second electrodes 250. Accordingly, the plurality of bending parts 211 are formed in zigzags in the length direction (direction X) of the dust collection sheet 210 between the plurality of first electrodes 240 and the plurality of second electrodes 250.

The first plane 212 including the first electrode 240 is placed on one end of the bending part 211, and the second plane 213 including the second electrode 250 is placed on the other end of the bending part 211 to face the first plane 212. With this structure, the plurality of first electrodes 240 and the plurality of second electrodes 250 may be alternately stacked in the length direction (direction X) of the dust collection sheet 210.

The first plane 212 including the first electrode 240, the bending part 211, and the second plane 213 including the second electrode 250 may be successively arranged, so that particles in the air passing between the plurality of first planes 212 and the plurality of second planes 213 may be easily collected.

The dust collection sheet 210 includes a plurality of openings 215 formed at the plurality of bending parts 211. With this structure, the air brought into a side past the charging unit 100 may pass the dust collection sheet 210 through the plurality of openings 215. As the plurality of first planes 212 and the plurality of second planes 213 face each other, gaps G are formed between the plurality of first planes 212 and the plurality of second planes 213 for the air to pass through. The air that has passed the charging unit 100 may be brought into the gaps G, and the air passing the gaps G may pass through the dust collection sheet 210 through the openings 215 formed at the bending parts 211 corresponding to the gaps G.

As the plurality of bending parts 211 are formed in zigzags, the air that has passed the charging unit 100 may be first brought into the openings 215 formed at the bending parts 211, and the air brought into the openings 215 may pass through the dust collection sheet 210 past the corresponding gaps G. As such, the dust collection sheet 210 may allow air to pass through the gaps G formed between the first planes 212 and the second planes 213 and the openings 215 formed at the bending parts 211.

Electric fields may be produced between the plurality of first electrodes 240 and the plurality of second electrodes 250 arranged on the plurality of first planes 212 and the plurality of second planes 213 facing each other, respectively. For example, the first electrode 240 may be formed of a high-voltage electrode, and the second electrode 250 may be formed of a low-voltage electrode, to which a lower voltage than a voltage applied to the first electrode 240 is applied. A high voltage may be applied to the first electrode 240, and the second electrode 250 may be grounded. An electric field may be produced by a potential difference between the first electrode 240 and the second electrode 250.

Furthermore, the electric field may be formed between the first electrode 240 and the second electrode 250 by applying positive power to the first electrode 240 and negative power to the second electrode 250. The voltage applied to the first electrode 240 and the second electrode 250 may be changed depending on the design or may be controlled based on the operation mode of the air conditioner 1.

Particles in the air, which are charged while passing the charging unit 100, may be adhered onto the second planes 213 including the second electrodes 250 while passing the gaps G between the first planes 212 and the second planes 213. Accordingly, the air passing the dust collection sheet 210 may be purified.

Moreover, the dust collection sheet 210 may further include extra spacing members (not shown) to keep a certain space between the first plane 212 and the second plane 213 to maintain a constant height (or size) H of the gap G. The spacing member may be placed between the first plane 212 and the second plane 213 to support the first plane 212 and the second plane 213 at a certain distance, and the height H of the gap G corresponding to the height of the spacing member may be set by differently setting the height of the spacing member.

The spacing members may be formed on the dust collection sheet 210 to have constant width and height with a heat melting adhesive such as hot melt, or may be formed by adhering both-sided adhesives having constant width and height to the dust collection sheet 210. For example, the bending parts 211 may be formed by successively applying the spacing members on one side of the dust collection sheet 210 unfolded before the dust collection sheet 210 is bent and bending the dust collection sheet 210 in zigzags. The height of the spacing member may be determined such that a sum of heights of two adjoining spacing members is equal to a preset height H of the gap G.

In other words, when the spacing members having half of the height H of the gap G are formed on both sides of the dust collection sheet 210 unfolded, the first plane 212 and the second plane 213 facing each other when the dust collection sheet 210 is bent may be supported by the spacing members. The height H of the gap G formed between the first plane 212 and the second plane 213 may remain constant.

Furthermore, in addition to the spacing member formed of the hot melt, the spacing member may be formed of an elastic and conductive substance or may be formed in the shape of a dot or a pillar placed between the first plane 212 and the second plane 213. It is desirable that the spacing member is formed to have as uniform and narrow width as possible not to interfere with a flow of the air passing the gap G and not to interfere with the production of an electric field between the first electrode 240 and the second electrode 250.

Figure 10:
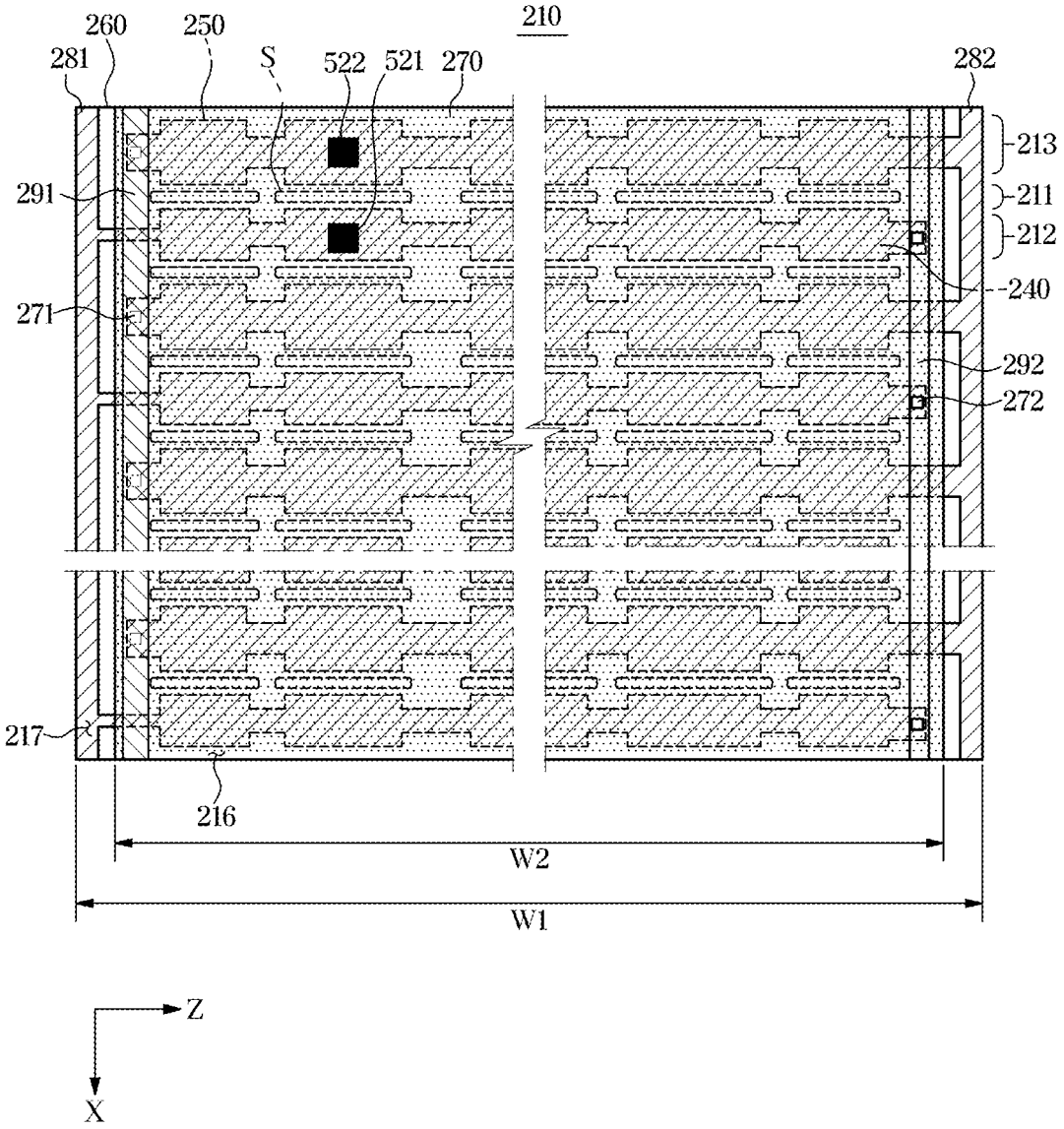
FIG. 10 is a plan view illustrating the dust collection sheet shown in FIG. 9 before being bent.

FIG. 10 is a plan view illustrating the dust collection sheet shown in FIG. 9 before being bent.

FIG. 10 shows the dust collection sheet 210 in an unfolded state before the dust collection sheet 210 is bent. The plan view of the dust collection sheet 210 as shown in FIG. 10 corresponds to the dust collection sheet 210 as shown in FIG. 8 rotated by 90 degrees and unfolded. As described above, the horizontal direction, vertical direction, width direction or length direction of the dust collection sheet 210 is a concept relatively defined based on a direction of view, and may be safely changed variously depending on a criterion.

The dust collection sheet 210 includes the first sheet 260 and the second sheet 270 laminated on the first sheet 260. The first sheet 260 and the second sheet 270 may be integrated into a piece of the dust collection sheet 210.

On the first sheet 260, the plurality of first electrodes 240 and the plurality of second electrodes 250) are alternately arranged in the direction X. The second sheet 270 is coupled onto one side of the first sheet 260 on which the plurality of first electrodes 240 and the plurality of second electrodes 250 are arranged, so that the plurality of first electrodes 240 and the plurality of second electrodes 250 may be located between the first sheet 260 and the second sheet 270. The first sheet 260 and the second sheet 270 may be merged through an adhesive.

It is desirable that the first sheet 260 may be formed of a film of a heat-resistant polyethylene terephthalate (PET) material, without being limited thereto. It is desirable that the second sheet 270 may be formed of a film of a heat-resistant ethylene vinyl acetate (EVA) material, without being limited thereto.

The first electrodes 240 and the second electrodes 250 are alternately arranged at regular intervals on one side of the first sheet 260 in the direction X. The length of each of the first electrode 240 and the second electrode 250 extends in the direction of Z on the first sheet 260. The first electrodes 240 and the second electrodes 250 may be formed of conductive patterns printed or deposited on the one side of the first sheet 260, in which case conductive carbon ink may be printed on the one side of the first sheet 260. It is not limited thereto, and the first electrodes 240 and the second electrodes 250 may be formed of a carbon film or a conductive metal such as aluminum and deposited on the first sheet 260.

Furthermore, on one side of the first sheet 260, a first power connector 281 connected to the first electrode 240 and a second power connector 282 connected to the second electrode 250 may be placed. The first power connector 281 and the second power connector 282 may be formed of conductive patterns printed or deposited on one side of the first sheet 260 in the same manner as the first electrode 240 and the second electrode 250.

The first power connector 281 and the second power connector 282 may be exposed out of the dust collection sheet 210 to receive external power. For this, width W1 of the first sheet 260 is formed to be larger than width W2 of the second sheet 270, and the first power connector 281 is arranged at one side end of the first sheet 260 and the second power connector 282 is arranged at the other side end of the first sheet 260.

The second sheet 270 may be coupled to a middle portion of one side of the first sheet 260 so that the first power connector 281 and the second power connector 282 may be exposed out of the first sheet 260, and the first electrode 240 and the second electrode 250 connected to the first power connector 281 and the second power connector 282, respectively, may be arranged between the first sheet 260 and the second sheet 270.

In the dust collecting operation, a high voltage is applied to the first power connector 281 so the first electrode 240 may be referred to as a high-voltage electrode and the second power connector 282 is grounded so the second electrode 250 may be referred to as a low-voltage electrode.

The dust collection sheet 210 includes slits S formed between the first electrodes 240 and the second electrodes 250. The plurality of slits S may be cuts that penetrate the dust collection sheet 210. The plurality of slits S may be formed at each of the plurality of bending parts 203 and may be widened by bending of the dust collection sheet 210, forming the plurality of openings 215 that allow air to pass through. Furthermore, the plurality of slits S may be formed in the shape of holes that occupy certain areas on the dust collection sheet 210 in the unfolded state.

As the bending parts 211 are formed by bending the portions between the first electrodes 240 and the second electrodes 250, the slits S may be formed in a center portion between the first electrode 240 and the second electrode 250 on the dust collection sheet 210. The slit S may be formed to be parallel with the first electrode 240 and the second electrode 250 in the length direction (direction Z) of the first electrode 240 and the second electrode 250, thereby being formed in the middle portion of the bending part 211. Accordingly, the opening 215 may be formed in the middle portion of the bending part 211.

The bending part 211 may be partitioned by a corner on one side of the first electrode 240 and a corner on one side of the second electrode 250, and the dust collection sheet 210 is bent based on the slit S formed in the center portion between the first electrode 240 and the second electrode 250 so that the first plane 212, the bending part 211 and the second plane 213 may be partitioned.

As described above, a potential difference may be made by applying different voltages to the first electrode 240 and the second electrode 250, and accordingly, charged particles may be collected on the second electrode 250 and/or the second plane 213.

The particles collected on the second electrode 250 and/or the second plane 213 may include harmful substances such as bacteria, viruses, or allergens. The dust collection sheet 210 needs to be sterilized because the collected harmful substances may possibly proliferate again. There is a method of sterilizing the dust collection sheet by using ultraviolet rays and plasma discharge among the traditional technologies, but such a method produces harmful by-products such as ozone. Furthermore, a traditional method which sterilizes air by heating the air with an extra beating device requires many components and consumes large power because of the extra heating device.

On the other hand, the electric dust collector 2 as disclosed herein is configured to maintain the structure for collecting charged particles using electric fields while being able to sterilize the dust collection sheet 210 by heating the electrodes 240 and 250 of the dust collection sheet 210. For example, as the second electrode 250 is heated, moisture contained in the particles collected on the second electrode 250 may be removed. Furthermore, protein denaturation of organic matters collected on the second electrode 250 may occur. Accordingly, the second electrode 250 may be sterilized.

In other words, the method of sterilizing the electric dust collector 2 as disclosed herein may sterilize the dust collection sheet 210 without producing the harmful by-products. Moreover, the method of sterilizing the electric dust collector 2 as disclosed herein may reduce energy consumption because the first electrode 240 and/or the second electrode 250 are directly heated without heating the moving air.

For this, on the second sheet 270, a third power connector 291 connected to the second electrode 250, to which an AC voltage is applied to heat the second electrode 250 and a fourth power connector 292 connected to the first electrode 240, to which an AC voltage is applied to heat the first electrode 240 may be placed.

When the AC voltage is applied to the second electrode 250, the second electrode 250 is heated and accordingly, the second electrode 250 may be sterilized. Likewise, when the AC voltage is applied to the first electrode 240, the first electrode 240 is heated and accordingly, the first electrode 240 may be sterilized. The first electrode 240 and the second electrode 250 may be formed of substances with high electrical resistance to produce heat. A method of sterilizing the dust collection sheet 210 will be described later.

The first power connector 281 may be formed as part of the first electrode 240. It is not limited thereto, and the first power connector 281 may be arranged as a separate component from the first electrode 240. For example, the first power connector 281 may be formed of a carbon film and deposited on the first sheet 260 or patterned on the first sheet 260 in carbon ink. The first power connector 281 may be arranged to extend in the second direction (direction X) perpendicular to the first direction (direction Z), which is a length direction of the first electrode 240 while the dust collection sheet 210 is unfolded before being bent. The first power connector 281 may be arranged to extend in the direction X to be electrically connected to the plurality of first electrodes 240.

The second power connector 282 may be formed as part of the second electrode 250. It is not limited thereto, and the first power connector 282 may be arranged as a separate component from the second electrode 250. For example, the second power connector 282 may be formed of a carbon film and deposited on the first sheet 260 or patterned on the first sheet 260 in carbon ink. The second power connector 282 may be arranged to extend in the second direction (direction X) perpendicular to the first direction (direction Z), which is a length direction of the second electrode 250 while the dust collection sheet 210 is unfolded before being bent. The second power connector 282 may be arranged in parallel with the first power connector 281. The second power connector 282 may be arranged to extend in the direction X to be electrically connected to the plurality of second electrodes 250.

The third power connector 291 is a separate component from the second electrode 250, and may be electrically connected to the second electrode 250 through a first coupling hole 271 of the second sheet 270. For example, the third power connector 291 may be formed of a carbon film and deposited on the second sheet 270 or patterned on the second sheet 270 in carbon ink. The third power connector 291 may be arranged to extend in the length direction (direction X) of the first power connector 281 while the dust collection sheet 210 is unfolded before being bent. The third power connector 291 may be arranged to extend in the direction X to be electrically connected to the plurality of second electrodes 250.

The fourth power connector 292 is a separate component from the first electrode 240, and may be electrically connected to the first electrode 240 through a second coupling hole 272 of the second sheet 270. For example, the fourth power connector 292 may be formed of a carbon film and deposited on the second sheet 270 or patterned on the second sheet 270 in carbon ink. The fourth power connector 292 may be arranged to extend in the length direction X of the second power connector 282 while the dust collection sheet 210 is unfolded before being bent. The fourth power connector 292 may be arranged to extend in the direction X to be electrically connected to the plurality of first electrodes 240.

The width W1 of the first sheet 260 is set to be larger than the width W2 of the second sheet 270, and the second sheet 270 may be coupled to the center portion on one surface of the first sheet 260. The first power connector 281 and the second power connector 282 may be exposed out of the first sheet 260. In other words, the first electrode 240 and the second electrode 250 may be arranged in a first region 216 on the dust collection sheet 210 where the first sheet 260 and the second sheet 270 overlap, and the first power connector 281 and the second power connector 282 may be arranged in a second region 217 of the dust collection sheet 210 where the first sheet 260 and the second sheet 270 do not overlap.

The third power connector 291 may not be placed between the first sheet 260 and the second sheet 270, and part of the third power connector 291 may penetrate the second sheet 270. The third power connector 291 may be exposed out of the dust collection sheet 210, and may be electrically connected to a power supplier 300. Furthermore, the third power connector 291 may be arranged to be close to an edge of the second sheet 270.

The fourth power connector 292 may not be placed between the first sheet 260 and the second sheet 270, and part of the fourth power connector 292 may penetrate the second sheet 270. The fourth power connector 292 may be exposed out of the dust collection sheet 210, and may be electrically connected to a power supplier 300. Furthermore, the fourth power connector 292 may be arranged to be close to an edge of the second sheet 270.

On the dust collection sheet 210, an electrode temperature sensor 520 may be arranged to measure a temperature of at least one of the first electrode 240 or the second electrode 250. For example, the electrode temperature sensor 520 may include at least one of a first electrode temperature sensor 521 arranged to measure a surface temperature of the first electrode 240 or a second electrode temperature sensor 522 arranged to measure a surface temperature of the second electrode 250. The first electrode temperature sensor 521 may transmit an electrical signal corresponding to the temperature of the first electrode 240 to the controller 400. The second electrode temperature sensor 522 may transmit an electrical signal corresponding to the temperature of the second electrode 250 to the controller 400.

Figure 11:
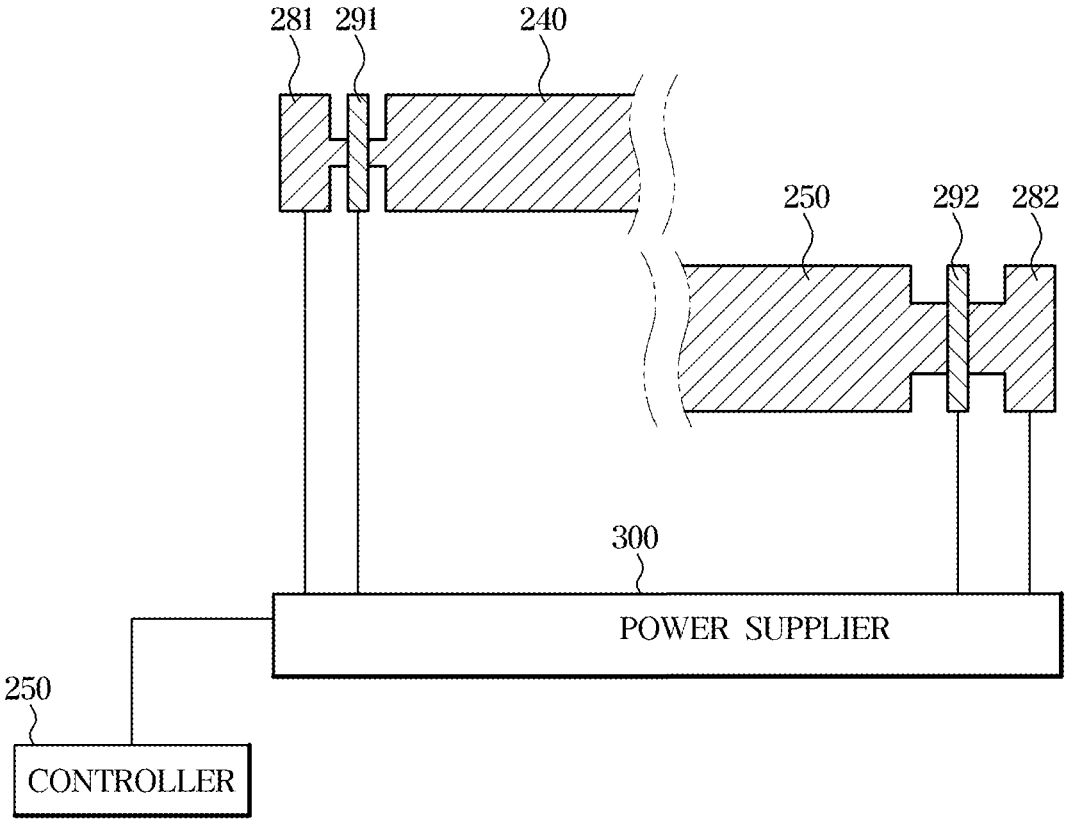
FIG. 11 schematically illustrates some components of an air conditioner, according to an embodiment.

FIG. 11 schematically illustrates some components of an air conditioner, according to an embodiment.

Referring to FIG. 11, the air conditioner 1 may include the power supplier 300 electrically connected to each of the first power connector 281, the second power connector 282, the third power connector 291 and the fourth power connector 292 arranged on the dust collection sheet 210 of the electric dust collector 2. The power supplier 300 may be electrically connected to the controller 400.

The power supplier 300 may supply or stop supplying separate power to each of the first power connector 281, the second power connector 282, the third power connector 291 and the fourth power connector 292 on the dust collection sheet 210 under the control of the controller 400. That is, the power supplier 300 may selectively supply power to the first power connector 281, the second power connector 282, the third power connector 291 and/or the fourth power connector 292.

For example, the power supplier 300 may include a plurality of switches (not shown) respectively connected to the first power connector 281, the second power connector 282, the third power connector 291 and the fourth power connector 292. Depending on the operation of each of the plurality of switches, a DC voltage or an AC voltage may be applied to the first electrode 240, and the second electrode 250 may be grounded or an AC voltage may be applied to the second electrode 250.

The controller 400 of the air conditioner 1 may control the power supplier 300 for the dust collection operation or the sterilizing operation of the electric dust collector 2. In the dust collection operation to collect particles in the air, the power supplier 300 may apply a DC voltage to the first electrode 240 through the first power connector 281, and may have the second electrode 250 grounded by making the second power connector 282 grounded. This may create a potential difference between the first electrode 240 and the second electrode 250, and charged particles may be collected on the second plane 213 including the second electrode 250.

When the dust collecting operation of the electric dust collector 2 continues, particles are constantly collected on the second electrode 250 and harmful substances contained in the particles, such as bacteria, viruses and allergens may proliferate. Hence, the controller 400 of the air conditioner 1 may determine to perform the sterilizing operation of the electric dust collector 2 according to a preset condition and control the power supplier 300 for the sterilizing operation of the electric dust collector 2. For example, the controller 400 may determine to perform at least one of a first sterilizing operation or a second sterilizing operation of the electric dust collector 2 based on at least one of a degree of contamination of the air having passed the dust collection sheet 210 or accumulated performance hours of the dust collecting operation.

In the first sterilizing operation, the first electrode 240 and the second electrode 250 may be heated at a preset first temperature for a first period of time. In the second sterilizing operation, the first electrode 240 and the second electrode 250 may be heated at a second temperature higher than the first temperature for a second period of time shorter than the first period of time.

The first temperature may be selected from within a range, e.g., from 30° C. to 50° C. The second temperature may be selected from within a range, e.g., from 50° C. to 80° C. The first period of time may be selected from within a range, e.g., from 10 to 30 minutes, and the second period of time may be selected from within a range, e.g., from 3 to 5 minutes. Proteins contained in the particles are denatured from about 40° C. The first sterilizing operation which sets the heating temperatures of the electrodes 240 and 250 of the dust collection sheet 210 to be relatively low may be referred to as a virus-proliferation inhibiting operation. The second sterilizing operation which sets the heating temperatures of the electrodes 240 and 250 of the dust collection sheet 210 to be relatively high may be referred to as a powerful sterilizing operation.

In the sterilizing operation to sterilize the dust collection sheet 210, the power supplier 300 may apply an AC voltage to the second electrode 250 through the second power connector 282 and the third power connector 291, and apply an AC voltage to the first electrode 240 through the first power connector 281 and the fourth power connector 292. As the AC voltages are applied to the first electrode 240 and the second electrode 250, the first electrode 240 and the second electrode 250 may be heated.

Effective values of the AC voltages applied to the first electrode 240 and the second electrode 250 in the sterilizing operation may be smaller than the magnitude of a DC voltage applied to the first electrode 240 in the dust collecting operation. However, the effective values of AC currents applied to the first electrode 240 and the second electrode 250 in the sterilizing operation may be greater than the magnitude of the DC voltage applied to the first electrode 240 in the dust collecting operation. An electric field needs to be produced without heating of the first electrode 240 and the second electrode 250 in the dust collecting operation, so high voltages and low currents may be applied to the first electrode 240 and the second electrode 250. By applying low voltages and high currents to the first electrode 240 and the second electrode 250 in the sterilizing operation, the first electrode 240 and the second electrode 250 may be heated.

A first effective value of the first AC voltage applied to the first electrode 240 and the second electrode 250 in the first sterilizing operation of the electric dust collector 2 may be smaller than the magnitude of a DC voltage applied to the first electrode 240 in the dust collecting operation. Although the second AC voltage applied to the first electrode 240 and the second electrode 250 in the second sterilizing operation of the electric dust collector 2 is higher than the first AC voltage in the first sterilizing operation, a second effective value of the second AC voltage may be smaller than the magnitude of the DC voltage applied to the first electrode 240 in the dust collecting operation.

The controller 400 may automatically perform the sterilizing operation of the electric dust collector 2 after the dust collecting operation of the electric dust collector 2 is finished. It is not, however, limited thereto, and the controller 400 may control the power supplier 300 to independently perform the sterilizing operation of the electric dust collector 2 based on a user command input through an input module 530 or a preset schedule.

Figure 12:
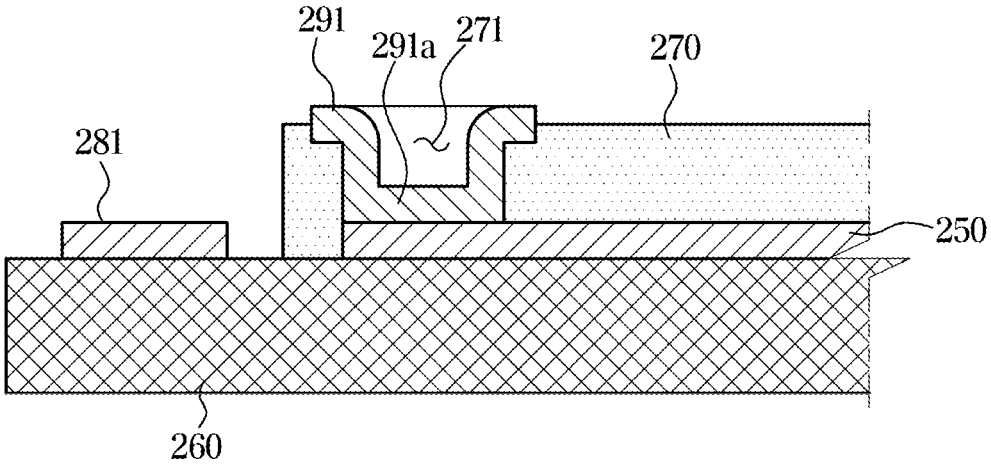
FIG. 12 is an enlarged view of a side cross-section of the dust collection sheet shown in FIG. 10.

FIG. 12 is an enlarged view of a side cross-section of the dust collection sheet shown in FIG. 10.

Referring to FIG. 12, the second electrode 250 is arranged between the first sheet 260 and the second sheet 270 of the dust collection sheet 210. The second sheet 270 of the dust collection sheet 210 may include the first coupling hole formed for part of the second electrode 250 to be exposed to the outside. The number of the first coupling holes 271 may be equal to the number of the second electrodes 250 arranged between the first sheet 260 and the second sheet 270.

The first coupling hole 271 may be formed on the dust collection sheet 210 to be adjacent to a side opposite to a side where the second power connector 282 is arranged. Specifically, the first coupling hole 271 may be formed to be closer to the first power connector 281 than to the second power connector 282. As an end of the second electrode 250 is connected to the second power connector 282, the first coupling hole 271 may be formed in a position corresponding to the other end of the second power connector 282 to connect the third power connector 201 to the other end of the second electrode 250.

The third power connector 291 may be deposited on the second sheet 270 through a carbon film or carbon ink. When the third power connector 291 is deposited on the second sheet 270, a portion 291*a* of the third power connector 291 covering the first coupling hole 271 may be inserted to the first coupling hole 271. The second electrode 250 may be in contact with and connected to the portion 291*a* of the third power connector 291 inserted to the first coupling bole 271.

Furthermore, as shown in FIG. 10, the first electrode 240 and the fourth power connector 292 may be connected through the second coupling hole 272 of the second sheet 270. The second coupling hole 272 may be formed in the same manner as the first coupling bole 271. A portion of the first electrode 240 may be exposed to the outside through the second coupling hole 272. The number of the second coupling holes 272 may be equal to the number of the first electrodes 240.

The second coupling hole 272 may be formed on the dust collection sheet 210 to be adjacent to a side opposite to a side where the first power connector 281 is arranged. Specifically, the second coupling bole 272 may be formed to be closer to the second power connector 282 than to the first power connector 281. As an end of the first electrode 240 is connected to the first power connector 281, the second coupling hole 272 may be formed in a position corresponding to the other end of the first power connector 281 to connect the fourth power connector 292 to the other end of the first electrode 240.

The fourth power connector 292 may be deposited on the second sheet 270 through a carbon film or carbon ink. When the fourth power connector 292 is deposited on the second sheet 270, a portion of the fourth power connector 292 covering the second coupling hole 272 may be inserted to the second coupling hole 272. The first electrode 240 may be in contact with and connected to the portion of the fourth power connector 292 inserted to the second coupling hole 272.

In the sterilizing operation of the electric dust collector 2, an AC voltage may be applied to the second electrode 250 through the second power connector 282 connected to an end of the second electrode 250 and the third power connector 291 connected to the other end of the second electrode 250. Furthermore, an AC voltage may be applied to the first electrode 240 through the first power connector 281 connected to an end of the first electrode 240 and the fourth power connector 292 connected to the other end of the first electrode 240. Accordingly, the first electrode 240 and the second electrode 250 may be heated.

Figure 13:
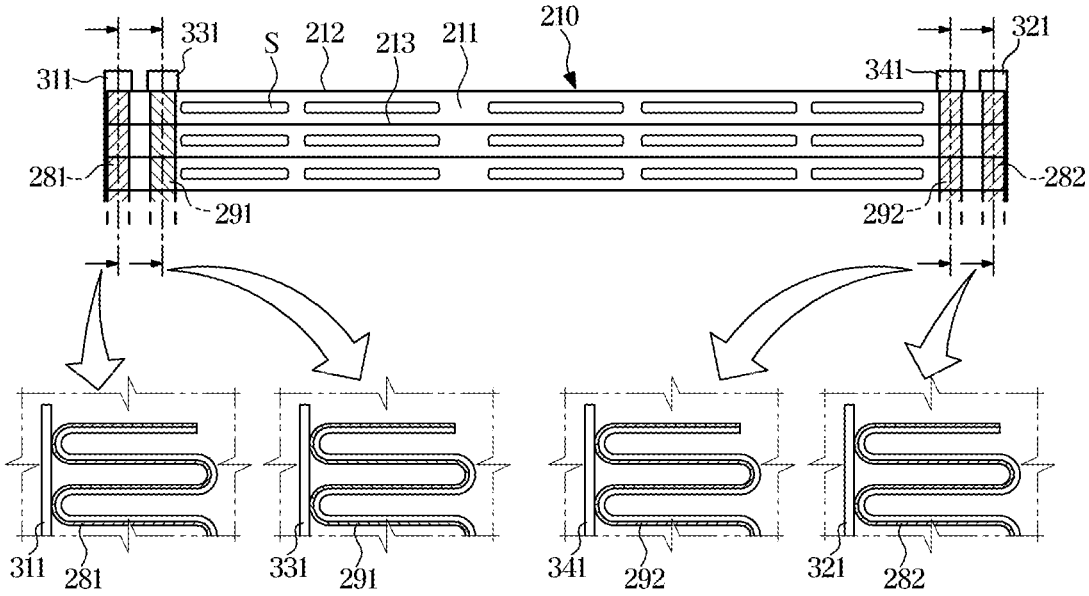
FIG. 13 illustrates connections between a dust collection sheet and a power supplier in an electric dust collector, according to an embodiment.

FIG. 13 illustrates connections between the dust collection sheet and the power supplier in an electric dust collector, according to an embodiment.

Referring to FIG. 13, the power supplier 300 may include a first contact part 311 contacting the first power connector 281, a second contact part 321 contacting the second power connector 282, a third contact part 331 contacting the third power connector 291, and a fourth contact part 341 contacting the fourth power connector 292. The first contact part 311 may contact a portion of the first power connector 281, the second contact part 321 may contact a portion of the second power connector 282, the third contact part 331 may contact a portion of the third power connector 291, and the fourth contact part 341 may contact a portion of the fourth power connector 292.

When the dust collection sheet 210 is bent, a portion of each of the first power connector 281, the second power connector 282, the third power connector 291 and the fourth power connector 292 may be arranged on the bending part 211. Specifically, the first contact part 311, the second contact part 321, the third contact part 331 and the fourth contact part 341 may contact respective parts of the first power connector 281, the second power connector 282, the third power connector 291 and the fourth power connector 292 located in the bending part 211.

The first electrode 240 and the second electrode 250 arranged on the dust collection sheet 210 may receive power from the power supplier 300 through the plurality of power connectors 281, 282, 291 and 292 and the plurality of contact parts 311, 321, 331 and 341.

Figure 14:
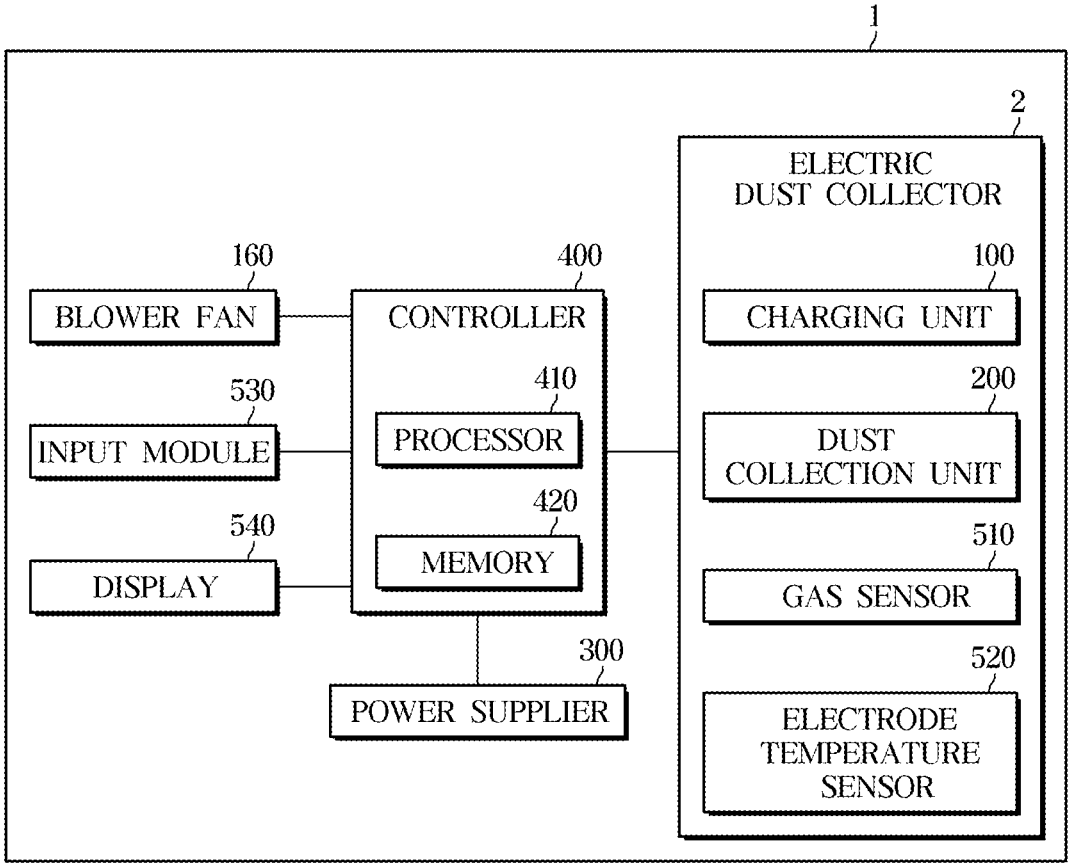
FIG. 14 is a control block diagram of an air conditioner, according to an embodiment.

FIG. 14 is a control block diagram of an air conditioner, according to an embodiment.

Referring to FIG. 14, the air conditioner 1 may include the electric dust collector 2, the blower fan 160, the power supplier 300, the controller 400, the input module 530, and a display 540. The electric dust collector 2 may include the charging unit 100, the dust collection unit 200, the gas sensor 510 and the electrode temperature sensor 520. The controller 400 may include a processor 410 and a memory 420.

The components of the air conditioner 1 may be electrically connected to the controller 400 and may be operated under the control of the controller 400. The power supplier 300 may supply power not only to the electric dust collector 2 but also to all the components of the air conditioner 1.

As described above, when the air conditioner 1 includes the heat exchanger 30, the air conditioner 1 may be connected to an outdoor unit (not shown). On the other hand, when the air conditioner 1 does not include the heat exchanger 30 to perform only an air purifying function, the air conditioner 1 is not connected to the outdoor unit.

The blower fan 160 may be arranged upstream or downstream of the electric dust collector 2 in the housing 10 of the air conditioner 1. Operation of the blower fan 160 may bring outside air into the air conditioner 1, and the air having passed the electric dust collector 2 may be discharged out of the air conditioner 1. A various number of blower fans 160 may be provided depending on the design. For example, when the air conditioner 1 is operated in a cooling mode, a heating mode or an air purification mode, the blower fan 160 may be operated.

The dust collecting operation of the electric dust collector 2 may be performed when the air conditioner 1 is operated in the cooling mode, the heating mode or the air purification mode. In other words, the dust collecting operation of the electric dust collector 2 may be performed along with the operation of the blower fan 160. To collect particles in the air brought into the air conditioner 1, the dust collecting operation of the electric dust collector 2 is performed. When the operation of the blower fan 160 is stopped, the dust collecting operation of the electric dust collector 2 may also be stopped. It is desirable that the sterilizing operation of the electric dust collector 2 may be performed after the dust collecting operation is finished.

The processor 410 may control the components of the air conditioner 1 based on instructions, an application, data and/or a program stored in the memory 420. The processor 410 may include logic circuits and operation circuits in hardware. The processor 410 may process data according to the program and/or instructions provided from the memory 420 and generate a control signal based on the processing result. The memory 420 and the processor 410 may be implemented in one control circuit or in a plurality of circuits.

The memory 420 may memorize/store various information required for operation of the air conditioner 1. The memory 420 may store instructions, an application, data and/or a program required for operation of the air conditioner 1. The memory 420 may include a volatile memory such as a static random access memory (S-RAM), dynamic RAM (D-RAM), etc., for temporarily storing data, and a non-volatile memory such as a read only memory (ROM), an erasable programmable ROM (EPROM), an electrically erasable programmable (ROM) (EEPROM), etc., for storing data for a long time.

The input module 530 may obtain a user input related to an operation of the air conditioner 1 from the user. Furthermore, the input module 530 may transmit an electrical signal (voltage or current) corresponding to the user input to the processor 410. The processor 410 may control an operation of the air conditioner 1 based on an electrical signal transmitted from the input module 530.

The input module 530 may include a plurality of buttons arranged on the housing 10 of the air conditioner 1. For example, the input module 530 may include an operation mode button to select the cooling mode, the heating mode or the air purification mode, a sterilization mode button to perform sterilization of the electric dust collector 2, a wind direction button to set a direction of wind and/or a wind volume button to set a wind intensity (a rotation velocity of the blower fan).

The plurality of buttons may include a membrane switch, a push switch activated by the pressure of the user and/or a touch switch activated by a touch of a body part of the user. Furthermore, the input module 530 may include a remote controller provided separately from the air conditioner 1 and a receiver for receiving a radio signal from the remote controller.

The display 540 may display information regarding a state and an operation of the air conditioner 1. The display 540 may display information regarding an operation of the air conditioner 1 in at least one of an image or text. The display 540 may be arranged on the frame 16 or the front panel 40 of the housing 10. The display 540 may be implemented with a liquid crystal display, a light emitting diode (LED), an organic LED and/or a micro LED. Furthermore, the display 540 may be implemented with a touch display. The touch display may include a display panel for displaying an image and a touch panel for receiving a touch input.

The controller 400 may determine to perform at least one of the first sterilizing operation or the second sterilizing operation of the electric dust collector 2 based on at least one of a degree of contamination of the air having passed the dust collection sheet 210 or accumulated performance hours of the dust collecting operation. The controller 400 may control the power supplier 300 to apply an AC voltage for the first sterilizing operation or the second sterilizing operation to the first electrode 240 and the second electrode 250.

In the meantime, when the air conditioner 1 includes the heat exchanger 30, the electric dust collector 2 and the heat exchanger 30 are arranged to be adjacent to each other, heat produced by a sterilizing operation of the electric dust collector 2 may dry the heat exchanger 30. Specifically, heat produced from the dust collection sheet 210 of the electric dust collector 2 may remove moisture in the heat exchanger 30 and get rid of viruses present on the surface of the heat exchanger 30. Accordingly, this may prevent occurrence of a bad smell.

In the first sterilizing operation, the first electrode 240 and the second electrode 250 may be heated at a preset first temperature for a first period of time. In the second sterilizing operation, the first electrode 240 and the second electrode 250 may be heated at a second temperature higher than the first temperature for a second period of time shorter than the first period of time.

A first effective value of the first AC voltage applied to the first electrode 240 and the second electrode 250 in the first sterilizing operation of the electric dust collector 2 may be smaller than the magnitude of a DC voltage applied to the first electrode 240 in the dust collecting operation. Although the second AC voltage applied to the first electrode 240 and the second electrode 250 in the second sterilizing operation of the electric dust collector 2 is higher than the first AC voltage in the first sterilizing operation, a second effective value of the second AC voltage may be smaller than the magnitude of the DC voltage applied to the first electrode 240 in the dust collecting operation.

The gas sensor 510 may measure a degree of contamination of the air that has passed the dust collection sheet 210. The gas sensor 510 may transmit an electric signal corresponding to the measured degree of contamination of the air to the controller 400, which will be described later. The controller 400 may determine to perform at least one of the first sterilizing operation or the second sterilizing operation to sterilize the dust collection sheet 210 based on the degree of contamination of the air measured by the gas sensor 510. The controller 400 may control the gas sensor 510 to measure the degree of contamination of air when operation of the air conditioner 1 is started. The degree of contamination of air may be measured periodically while the dust collecting operation of the electric dust collector 2 is performed.

The controller 400 may determine to sequentially perform the first sterilizing operation and the second sterilizing operation based on the degree of contamination of the air measured by the gas sensor 510 equal to or greater than a preset reference degree of contamination. When the degree of contamination of the air is equal to or greater than the preset reference degree of contamination, it may mean that relatively many particles containing harmful substances have been collected on the dust collection sheet 210. Hence, when the degree of contamination of the air is high, the dust collection sheet 210 may be dried by the first sterilizing operation and the dust collection sheet 210 may then be cleaned by powerfully sterilizing the dust collection sheet 210 in the second sterilizing operation.

Furthermore, the controller 400 may determine to perform the first sterilizing operation based on the degree of contamination of the air measured by the gas sensor 510 lower than the preset reference degree of contamination. Specifically, when the degree of contamination of the air is lower than the reference degree of contamination, the second sterilizing operation of the electric dust collector 2 may not be performed. When the degree of contamination of the air is lower than the reference degree of contamination, it means that relatively less particles are collected on the dust collection sheet 210, which may lead to performing the first sterilizing operation to inhibit proliferation of viruses. In this case, the second sterilizing operation is omitted, thereby reducing energy consumption.

In the meantime, the controller 400 may count accumulated performance hours of the dust collecting operation of the electric dust collector 2. The accumulated performance hours of the dust collecting operation may refer to accumulated operation hours for which the air conditioner 1 has performed a cooling operation, a heating operation or an air purifying operation. The controller 400 may determine to perform the second sterilizing operation of the dust collection sheet 210 based on the accumulated performance hours of the dust collecting operation reaching preset reference hours. For example, when the accumulated performance hours of the dust collecting operation reach 12 hours, the controller 400 may control the power supplier 300 for the second sterilizing operation of the dust collection sheet 210 or control the power supplier 300 to sequentially perform the first sterilizing operation and the second sterilizing operation of the dust collection sheet 210. The sterilizing operation of the electric dust collector 2 may be performed periodically according to the accumulated performance hours of the dust collecting operation.

Furthermore, the controller 400 may reset the accumulated performance hours of the dust collecting operation based on the performance of the second sterilizing operation of the electric dust collector 2. For example, the accumulated performance hours of the dust collecting operation may be initialized to 0 at the entrance into the second sterilizing operation. The accumulated performance hours of the dust collecting operation may be counted again from the next dust collecting operation after the second sterilizing operation. Cleanliness of the electric dust collector 2 may increase by periodically sterilizing the dust collection sheet 210 based on hours for which the dust collecting operation of the electric dust collector 2 has been performed.

The electrode temperature sensor 520 may be arranged on at least one of the first electrode 240 or the second electrode 250 of the dust collection sheet 210. The electrode temperature sensor 520 may measure temperature of at least one of the first electrode 240 or the second electrode 250. The electrode temperature sensor 520 may transmit an electrical signal corresponding to the measured temperature to the controller 400.

For example, the electrode temperature sensor 520 may include at least one of the first electrode temperature sensor 521 arranged to measure a surface temperature of the first electrode 240 or the second electrode temperature sensor 522 arranged to measure a surface temperature of the second electrode 250. The first electrode temperature sensor 521 may transmit an electrical signal corresponding to the temperature of the first electrode 240 to the controller 400. The second electrode temperature sensor 522 may transmit an electrical signal corresponding to the temperature of the second electrode 250 to the controller 400. The electrode temperature sensor 520 (521 and 522) may be implemented with a thermistor whose electric resistance changes according to the temperature.

Apart from this, the air conditioner 1 may include various temperature sensors. For example, there may be a temperature sensor for measuring temperature of an indoor space where the air conditioner 1 is placed, a temperature sensor for measuring temperature of air brought in through the inlet 12 and/or a temperature sensor for measuring temperature of air discharged through the front panel 40 may be arranged.

The controller 400 may control the power supplier 300 to stop applying an AC voltage to the first electrode 240 and the second electrode 250 based on the temperature of the electrodes 240 and 250 measured by the electrode temperature sensor 520 reaching a first limit temperature for the first sterilizing operation of the dust collection sheet 210 or a second limit temperature for the second sterilizing operation of the dust collection sheet 210.

For example, in the first sterilizing operation of the electric dust collector 2, the first electrode 240 and the second electrode 250 may be heated at a first temperature in a range from 30° C. to 50° C. The temperatures of the first electrode 240 and the second electrode 250 may continuously increase and happen to reach the first limit temperature higher than the first temperature.

An excessive increase in temperature of the first electrode 240 and the second electrode 250 may cause a result deviating from a purpose of the first sterilizing operation and unnecessary energy consumption. Hence, when temperatures of the first electrode 240 and the second electrode 250 reach the first limit temperature in the first sterilizing operation, the controller 400 may control the power supplier 300 to stop applying the AC voltage to the first electrode 240 and the second electrode 250.

In the second sterilizing operation of the electric dust collector 2, the first electrode 240 and the second electrode 250 may be heated at the second temperature in a range from 50° C. to 80° C. The temperatures of the first electrode 240 and the second electrode 250 may continuously increase and happen to reach the second limit temperature higher than the second temperature.

When the temperatures of the first electrode 240 and the second electrode 250 exceed the second limit temperature, the first electrode 240 and the second electrode 250 may be damaged. Hence, when temperatures of the first electrode 240 and the second electrode 250 reach the second limit temperature in the second sterilizing operation, the controller 400 may control the power supplier 300 to stop applying the AC voltage to the first electrode 240 and the second electrode 250.

Furthermore, the controller 400 may control the power supplier 300 to adjust the AC voltage applied to the first electrode 240 and the second electrode 250 based on feedback from the electrode temperature sensor 520 to maintain the first electrode 240 and the second electrode 250 at a constant temperature. For example, the controller 400 may control the power supplier 300 to apply or stop applying the AC voltage to the first electrode 240 and the second electrode 250 based on the feedback from the electrode temperature sensor 520. The amplitude of the AC voltage applied to the first electrode 240 and the second electrode 250 may be adjusted.

Some of the components of the air conditioner 1 shown in FIG. 14 may be omitted. Furthermore, other components than the components shown in FIG. 14 may be added. For example, the air conditioner 1 may further include a communication module (not shown) for communicating with an external device. It will be obvious to those of ordinary skill in the art that the relative positions of the components may be changed to correspond to the system performance or structure.

Figure 15:
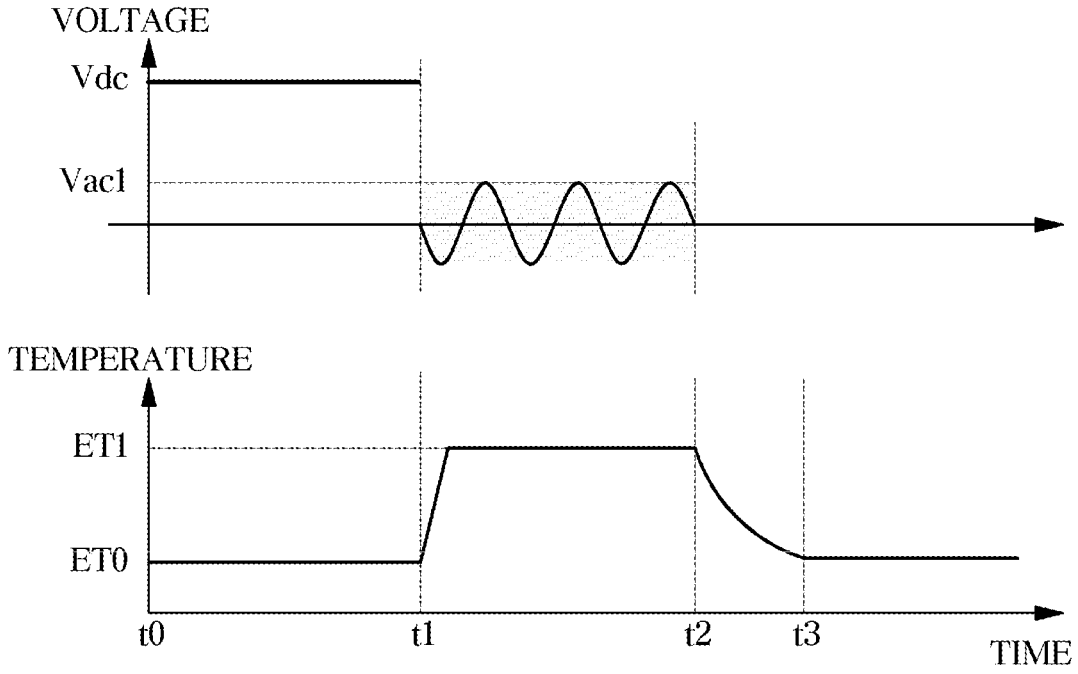
FIG. 15 illustrates graphs representing changes in voltage applied to an electrode and changes in temperature of the electrode of a dust collection sheet in a first sterilizing operation of an electric dust collector, according to an embodiment.

FIG. 15 illustrates graphs representing changes in voltage applied to an electrode and changes in temperature of the electrode of a dust collection sheet in a first sterilizing operation of an electric dust collector, according to an embodiment.

Referring to FIG. 15, a dust collecting operation of the electric dust collector 2 is performed from time t0 to time t1. The air conditioner 1 performs a cooling operation, a heating operation or an air purifying operation by driving the blower fan 160 from time t0 to time t1.

To perform a dust collecting operation to collect particles in the air, the controller 400 may control the power supplier 300 to supply power to the charging unit 100 and control the power supplier 300 to apply a DC voltage Vdc to the first electrode 240 of the dust collection sheet 210 included in the electric dust collector 2. The controller 400 may also control the power supplier 300 to have the second electrode 250 of the dust collection sheet 210 grounded. This may cause a potential difference between the first electrode 240 and the second electrode 250, producing an electric field. The particles in the air charged by the charging unit 100 may be collected on the second electrode 250.

From time t0 to time t1 for which the dust collecting operation is performed, the first electrode 240 and the second electrode 250 remain at a room temperature ET0. In other words, during the dust collecting operation, the first electrode 240 and the second electrode 250 are not heated.

The controller 400 may basically perform the first sterilizing operation of the electric dust collector 2 after the dust collecting operation of the electric dust collector 2 is finished. Specifically, at time t1, the blower fan 160 is stopped at the stop of the cooling operation, heating operation or air purifying operation of the air conditioner 1, and the first sterilizing operation may be started to sterilize the dust collection sheet 210 of the electric dust collector 2. The first sterilizing operation may be performed for a first period of time (from time t1 to time t2). For example, the first period of time from time t1 to time t2 may be 10 minutes. The first period of time may be selected from within a range from 10 to 30 minutes.

For the first sterilizing operation of the electric dust collector 2, the controller 400 may control the power supplier 300 to apply a first AC voltage Vac1 to the first electrode 240 and the second electrode 250 of the dust collection sheet 210. The controller 400 may control the power supplier 300 to apply the first AC voltage Vac1 to the first electrode 240 and the second electrode 250 from time t1 to time t2 and stop applying the first AC voltage Vac1 at time t2.

As the first AC voltage Vac1 is applied to the first electrode 240 and the second electrode 250, the first electrode 240 and the second electrode 250 may be heated. Temperatures of the first electrode 240 and the second electrode 250 may increase from time t1 and reach a first temperature ET1. The first electrode 240 and the second electrode 250 may remain at the first temperature ET1 until time t2. The first temperature ET1 may be selected from within a range, e.g., from 30° C. to 50° C.

As no voltage is applied to the first electrode 240 and the second electrode 250 from time t2, temperatures of the first electrode 240 and the second electrode 250 may gradually decrease and go back to the room temperature ET0 at time t3.

As such, as the first sterilizing operation of the electric dust collector 2 is performed, moisture contained in the particles collected on the dust collection sheet 210 may be removed, which may inhibit virus proliferation.

Figure 16:
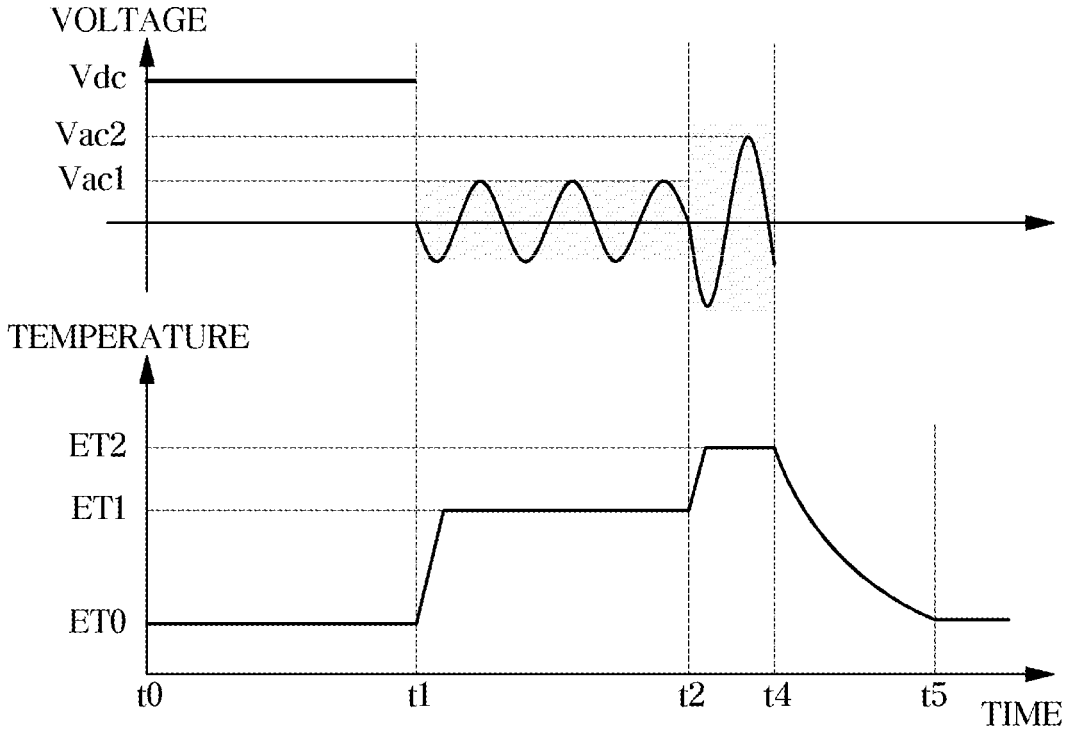
FIG. 16 illustrates graphs representing changes in voltage applied to an electrode and changes in temperature of the electrode of a dust collection sheet when a first sterilizing operation and a second sterilizing operation of an electric dust collector are sequentially performed, according to an embodiment.

FIG. 16 illustrates graphs representing changes in voltage applied to an electrode and changes in temperature of the electrode of a dust collection sheet when a first sterilizing operation and a second sterilizing operation of an electric dust collector are sequentially performed, according to an embodiment.

Referring to FIG. 16, a dust collecting operation of the electric dust collector 2 is performed from time t0 to time t1. The air conditioner 1 performs a cooling operation, a heating operation or an air purification operation by driving the blower fan 160 from time t0 to time t1. The controller 400 may control the gas sensor 510 to measure the degree of contamination of air having passed the electric dust collector 2 during the operation of the air conditioner 1.

The controller 400 may determine to perform at least one of the first sterilizing operation or the second sterilizing operation of the electric dust collector 2 based on at least one of a degree of contamination of the air having passed the dust collection sheet 210 or accumulated performance hours of the dust collecting operation. For example, when the degree of contamination of the air measured between time t0 and time t1 is equal to or greater than a preset reference degree of contamination, the controller 400 may determine to sequentially perform the first sterilizing operation and the second sterilizing operation.

When the degree of contamination of the air is equal to or greater than the preset reference degree of contamination, it may mean that relatively many particles containing harmful substances have been collected on the dust collection sheet 210. Hence, when the degree of contamination of the air is high, the dust collection sheet 210 may be dried by the first sterilizing operation and the dust collection sheet 210 may then be cleaned by powerfully sterilizing the dust collection sheet 210 in the second sterilizing operation.

The controller 400 may perform the first sterilizing operation of the electric dust collector 2 from time t1 at which the dust collecting operation of the electric dust collector 2 is finished. The controller 400 may control the power supplier 300 to apply the first AC voltage Vac1 to the first electrode 240 and the second electrode 250 of the dust collection sheet 210 for the first period of time from time t1 to time t2. Accordingly, the first electrode 240 and the second electrode 250 may be heated, and the first electrode 240 and the second electrode 250 may remain at the first temperature ET1 until time t2. The first temperature may be selected from within a range, e.g., from 30° C. to 50° C. While the first sterilizing operation is performed, moisture contained in the particles collected on the dust collection sheet 210 may be removed.

For a second period of time from time t2 to time t4, the second sterilizing operation of the electric dust collector 2 may be performed. The second period of time may be set to be shorter than the first period of time. The second period of time may be selected from within a range e.g., from 3 to 5 minutes. The controller 400 may control the power supplier 300 to apply a second AC voltage Vac2 higher than the first AC voltage Vac1 to the first electrode 240 and the second electrode 250 for a second period of time. The first electrode 240 and the second electrode 250 may be heated at the second temperature ET2 higher than the first temperature ET1 for the second period of time. The second temperature ET2 may be selected from within a range, e.g., from 50° C. to 80° C. While the second sterilizing operation is performed, protein denaturation of organic matters contained in the particles collected on the dust collection sheet 210 may occur and thus, the dust collection sheet 210 may be sterilized.

The controller 400 may control the power supplier 300 to stop applying the second AC voltage Vac2 from time t4. As no voltage is applied to the first electrode 240 and the second electrode 250 from time t4, temperatures of the first electrode 240 and the second electrode 250 may gradually decrease and go back to the room temperature ET0 at time t5.

Figure 17:
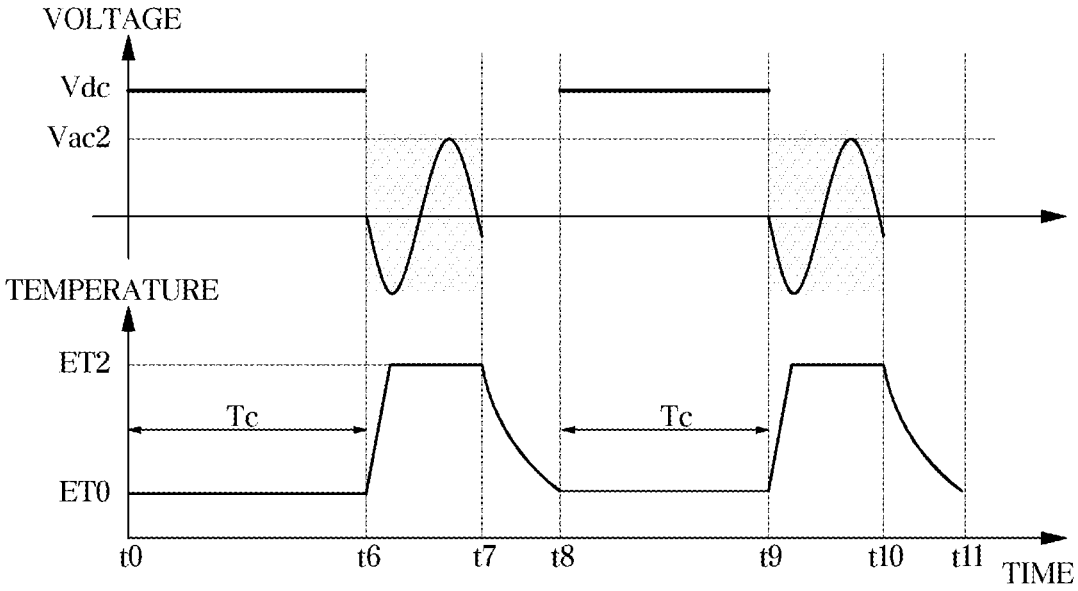
FIG. 17 illustrates graphs representing changes in voltage applied to an electrode and changes in temperature of the electrode of a dust collection sheet when a second sterilizing operation is performed based on accumulated performance hours of a dust collecting operation of an electric dust collector.

FIG. 17 illustrates graphs representing changes in voltage applied to an electrode and changes in temperature of the electrode of a dust collection sheet when a second sterilizing operation is performed based on accumulated performance hours of a dust collecting operation of an electric dust collector.

Referring to FIG. 17, a dust collecting operation of the electric dust collector 2 is performed from time t0 to time t6. The air conditioner 1 performs a cooling operation, a heating operation or an air purifying operation by driving the blower fan 160 from time t0 to time t6. The controller 400 may check accumulated performance hours Tc of the dust collecting operation of the electric dust collector 2. The accumulated performance hours Tc of the dust collecting operation may refer to accumulated operation hours for which the air conditioner 1 has performed a cooling operation, a heating operation or an air purifying operation. The accumulated performance hours Tc may include performance hours of the dust collecting operation performed before time t0.

The controller 400 may determine to perform the second sterilizing operation of the dust collection sheet 210 based on the accumulated performance hours Tc of the dust collecting operation performed until time t6 reaching the preset reference hours. For example, when the accumulated performance hours Tc counted until time t6 are 12 hours, the controller 400 may control the power supplier 300 to apply the second AC voltage Vac2 to the first electrode 240 and the second electrode 250 after time t6 for the second sterilizing operation of the dust collection sheet 210. The second AC voltage Vac2 may be applied to the first electrode 240 and the second electrode 250 for the second period of time from time t0 to time t7. The second period of time may be within a range e.g., from 3 to 5 minutes. Accordingly, the first electrode 240 and the second electrode 250 of the electric dust collector 2 may be heated at the second temperature ET2 in a range from 50° C. to 80° C. for the second period of time.

The controller 400 may control the power supplier 300 to stop applying the second AC voltage Vac2 from time t7. As no voltage is applied to the first electrode 240 and the second electrode 250 from time t7, temperatures of the first electrode 240 and the second electrode 250 may gradually decrease and go back to the room temperature ET0 at time t8.

The controller 400 may reset the accumulated performance hours Tc of the dust collecting operation based on the performance of the second sterilizing operation of the electric dust collector 2. For example, the accumulated performance hours Tc of the dust collecting operation may be initialized to 0 at time t6 at which to enter the second sterilizing operation.

The accumulated performance hours Tc of the dust collecting operation may be counted again from the next dust collecting operation after the second sterilizing operation. Specifically, the dust collecting operation of the electric dust collector 2 may be performed again from time t8, and for the dust collecting operation, the DC voltage Vdc may be reapplied to the first electrode 240 from time t8. The dust collecting operation may be performed until time t9, and the controller 400 counts performance hours of the dust collecting operation from time t8 to time t9. The controller 400 may determine to perform the second sterilizing operation after time t9 when the accumulated performance hours Tc of the dust collecting operation until time t9 reach the preset reference hours.

The second AC voltage Vac2 may be applied to the first electrode 240 and the second electrode 250 of the dust collection sheet 210 from time t9 to time t10, and the first electrode 240 and the second electrode 250 may be heated at the second temperature ET2. The controller 400 may control the power supplier 300 to stop applying the second AC voltage Vac2 from time t10. As such, the sterilizing operation of the electric dust collector 2 may be performed periodically according to the accumulated performance hours Tc of the dust collecting operation.

Although an example in which the second sterilizing operation of the electric dust collector 2 is performed periodically is taken in FIG. 17, it is not limited thereto. The controller 400 may determine to sequentially perform the first sterilizing operation and the second sterilizing operation of the dust collection sheet 210 based on the accumulated performance hours Tc of the dust collecting operation performed until time t6 reaching the preset reference hours. In other words, the first sterilizing operation and the second sterilizing operation as described in FIG. 16 may be performed periodically according to the accumulated performance hours Tc of the dust collecting operation.

Figure 18:
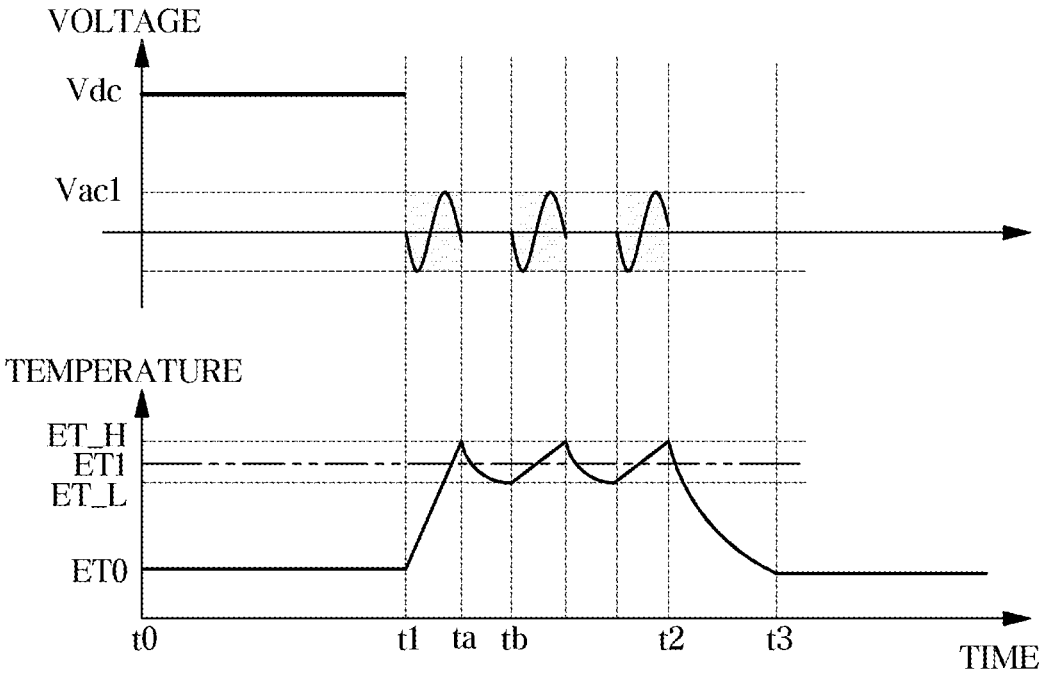
FIG. 18 illustrates graphs representing the voltage applied to an electrode of a dust collection sheet, which is adjusted based on temperature of the electrode, according to an embodiment.

FIG. 18 illustrates graphs representing the voltage applied to an electrode of a dust collection sheet, which is adjusted based on temperature of the electrode, according to an embodiment.

As described above, the controller 400 may control the power supplier 300 to adjust the AC voltage applied to the first electrode 240 and the second electrode 250 based on feedback from the electrode temperature sensor 520 to maintain the first electrode 240 and the second electrode 250 at a constant temperature. For example, the controller 400 may control the power supplier 300 to apply or stop applying the AC voltage to the first electrode 240 and the second electrode 250 based on the feedback from the electrode temperature sensor 520. The amplitude of the AC voltage applied to the first electrode 240 and the second electrode 250 may be adjusted.

The controller 400 may control the power supplier 300 to stop applying an AC voltage to the first electrode 240 and the second electrode 250 based on the temperature of the electrodes 240 and 250 measured by the electrode temperature sensor 520 reaching the first limit temperature for the first sterilizing operation of the dust collection sheet 210 or the second limit temperature for the second sterilizing operation of the dust collection sheet 210.

For example, as shown in FIG. 18, in the first sterilizing operation of the electric dust collector 2, the first electrode 240 and the second electrode 250 of the dust collection sheet 210 may be heated at the first temperature ET1. The temperatures of the first electrode 240 and the second electrode 250 may continuously increase and happen to reach a first limit temperature ET_H higher than the first temperature ET1.

An excessive increase in temperature of the first electrode 240 and the second electrode 250 may cause a result deviating from a purpose of the first sterilizing operation and unnecessary energy consumption. Hence, when temperatures of the first electrode 240 and the second electrode 250 reach the first limit temperature ET_H in the first sterilizing operation (at time ta), the controller 400 may control the power supplier 300 to stop applying the first AC voltage Vac1 to the first electrode 240 and the second electrode 250.

As no voltage is applied to the first electrode 240 and the second electrode 250, temperatures of the first electrode 240 and the second electrode 250 may decrease. Hence, when temperatures of the first electrode 240 and the second electrode 250 go down to a lower limit temperature ET_L lower than the first temperature ET1 (at time tb), the controller 400 may control the power supplier 300 to apply the first AC voltage Vac1 to the first electrode 240 and the second electrode 250 again.

As such, the first electrode 240 and the second electrode 250 may remain at a constant temperature within a preset range by controlling application of the AC voltage to the first electrode 240 and the second electrode 250 based on a change in temperature of the first electrode 240 and the second electrode 250. In other words, application of the first AC voltage Vac1 may be controlled so that the temperature of the first electrode 240 and the second electrode 250 follows the first temperature ET1. A median value of the first limit temperature ET_H and the lower limit temperature ET_L related to the first sterilizing operation of the electric dust collector 2 may correspond to the first temperature ET1.

Even in the second sterilizing operation of the electric dust collector 2, the first electrode 240 and the second electrode 250 may remain at a constant temperature in the same method as the method described in FIG. 18.

Figure 19:
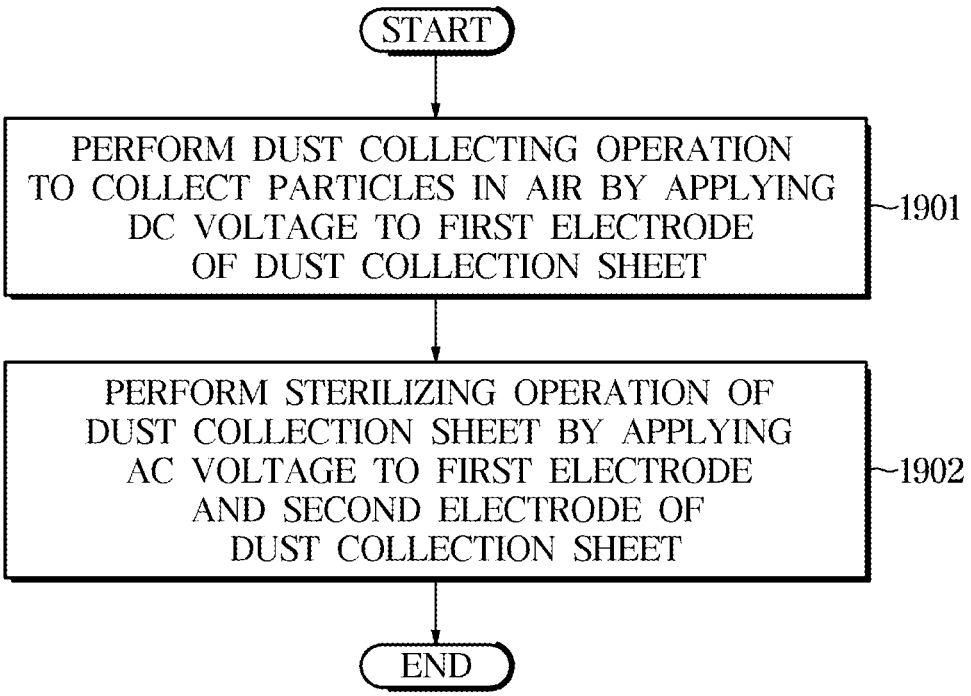
FIG. 19 is a flowchart briefly describing a method of controlling an air conditioner, according to an embodiment.
Figure 20:
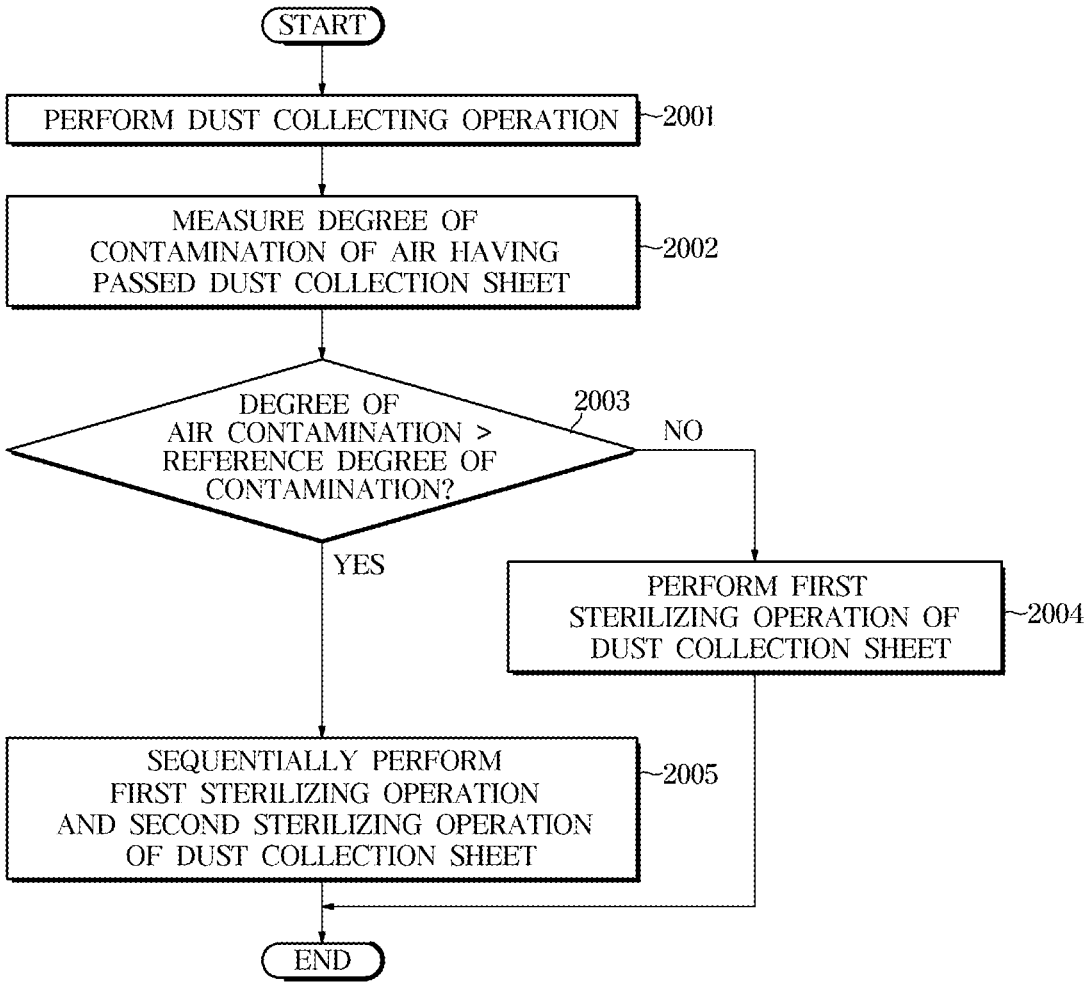
FIG. 20 is a flowchart describing an example of a method of controlling an air conditioner to perform a sterilizing operation according to a degree of air contamination.
Figure 21:
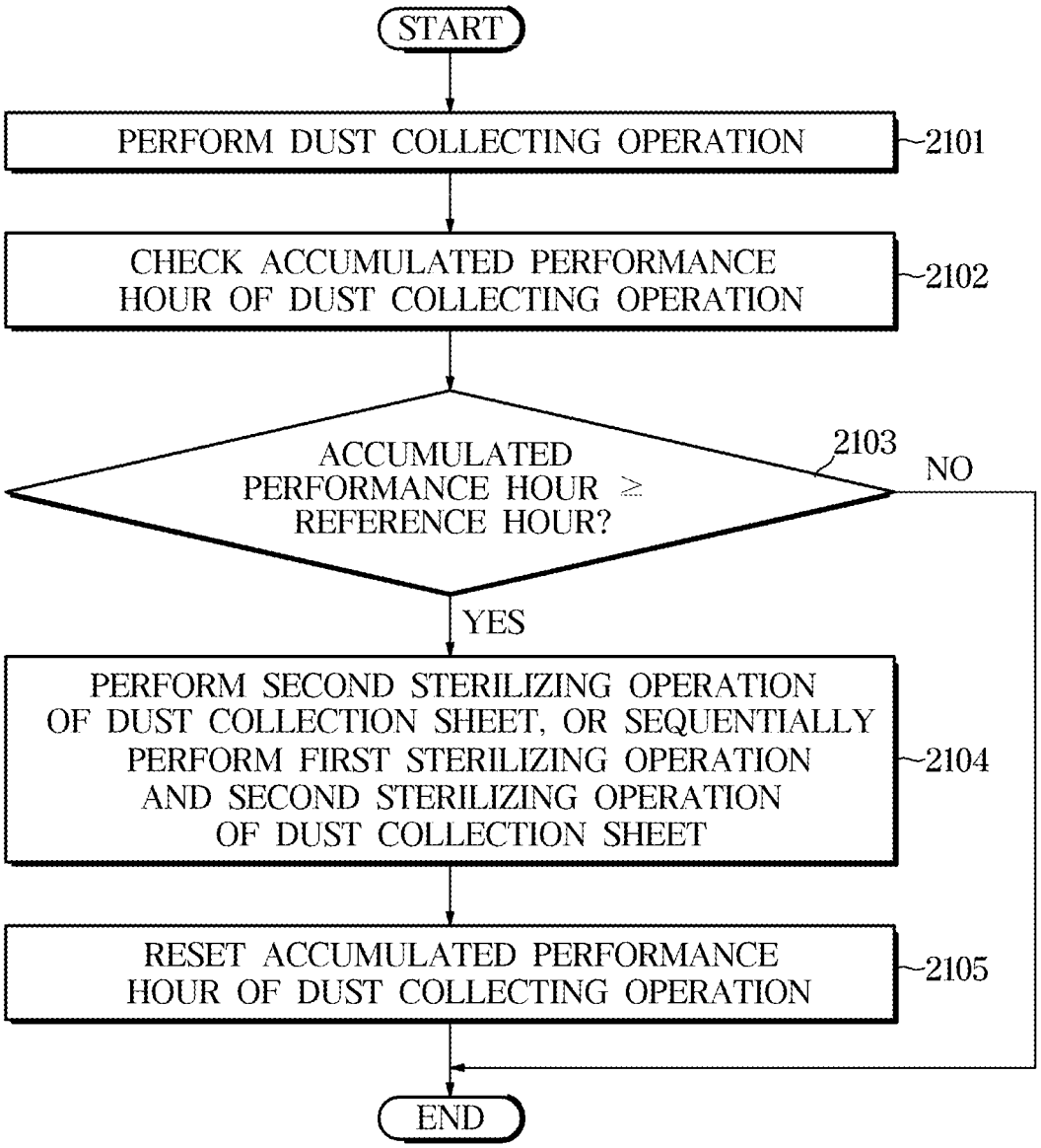
FIG. 21 is a flowchart describing an example of a method of controlling an air conditioner to perform a sterilizing operation according to accumulated performance hours of a dust collecting operation.

FIG. 19 is a flowchart briefly describing a method of controlling an air conditioner, according to an embodiment. FIG. 20 is a flowchart describing an example of a method of controlling an air conditioner to perform a sterilizing operation according to a degree of air contamination. FIG. 21 is a flowchart describing an example of a method of controlling an air conditioner to perform a sterilizing operation according to accumulated performance hours of a dust collecting operation.

Referring to FIG. 19, to collect particles in the air brought into the air conditioner 1, the dust collecting operation of the electric dust collector 2 may be performed. The dust collecting operation of the electric dust collector 2 may be performed when the air conditioner 1 is operated in the cooling mode, the heating mode or the air purification mode. The controller 400 of the air conditioner 1 may control the power supplier 300 to apply a DC voltage to the first electrode 240 of the dust collection sheet 210 included in the electric dust collector 2 to perform the dust collecting operation to collect particles in the air, in operation 1901. In the dust collecting operation of the electric dust collector 2, the second electrode 250 of the dust collection sheet 210 may be grounded.

Furthermore, the sterilizing operation of the electric dust collector 2 may be performed to sterilize the dust collection sheet 210 included in the electric dust collector 2. The controller 400 of the air conditioner 1 may control the power supplier 300 to apply an AC voltage to the first electrode 240 and the second electrode 250 of the dust collection sheet 210, in operation 1902. As described above, the controller 400 may determine to perform at least one of the first sterilizing operation or the second sterilizing operation of the electric dust collector 2 according to a preset condition.

The controller 400 may automatically perform the sterilizing operation of the electric dust collector 2 after the dust collecting operation of the electric dust collector 2 is finished. It is not, however, limited thereto, and the controller 400 may control the power supplier 300 to independently perform the sterilizing operation of the electric dust collector 2 based on a user command input through the input module 530 or a preset schedule Referring to FIG. 20, after the dust collecting operation of the electric dust collector 2 is finished in operation 2001, the controller 400 may control the gas sensor 510 to measure a degree of contamination of air having passed the dust collection sheet 210 in operation 2002. It is not limited thereto, and the controller 400 may control the gas sensor 510 to measure the degree of contamination of air when operation of the air conditioner 1 is started.

The controller 400 may determine to perform at least one of the first sterilizing operation or the second sterilizing operation to sterilize the dust collection sheet 210 based on the degree of contamination of the air measured by the gas sensor 510. The controller 400 may determine to perform the first sterilizing operation based on the degree of contamination of the air measured by the gas sensor 510 lower than a preset reference degree of contamination. Specifically, when the degree of contamination of the air is lower than the reference degree of contamination, the second sterilizing operation of the electric dust collector 2 may not be performed in operations 2003 and 2004. The controller 400 may determine to sequentially perform the first sterilizing operation and the second sterilizing operation based on the degree of contamination of the air measured by the gas sensor 510 equal to or greater than the preset reference degree of contamination, in operations 2003 and 2005.

Referring to FIG. 21, the controller 400 may control the power supplier 300 to perform a dust collecting operation of the electric dust collector 2 in operation 2101, and check accumulated performance hours of the dust collecting operation of the electric dust collector 2 in operation 2102. The accumulated performance hours of the dust collecting operation may refer to accumulated operation hours for which the air conditioner 1 has performed a cooling operation, a heating operation or an air purification operation.

The controller 400 may determine to perform the second sterilizing operation of the dust collection sheet 210 based on the accumulated performance hours of the dust collecting operation reaching preset reference hours. The controller 400 may control the power supplier 300 for the second sterilizing operation of the dust collection sheet 210 or control the power supplier 300 to sequentially perform the first sterilizing operation and the second sterilizing operation of the dust collection sheet 210, in operations 2103 and 2104.

Furthermore, the controller 400 may reset the accumulated performance hours of the dust collecting operation based on the performance of the second sterilizing operation of the electric dust collector 2, in operation 2105. For example, the accumulated performance hours of the dust collecting operation may be initialized to 0 at the entrance into the second sterilizing operation. The accumulated performance hours of the dust collecting operation may be counted again from the next dust collecting operation after the second sterilizing operation. Cleanliness of the electric dust collector 2 may increase by periodically sterilizing the dust collection sheet 210 based on hours for which the dust collecting operation of the electric dust collector 2 has been performed.

As such, an air conditioner and method for controlling the same as disclosed herein may automatically perform a sterilizing operation to sterilize electrodes of a dust collection sheet included in an electric dust collector, thereby keeping the electric dust collector clean.

An air conditioner and method for controlling the same as disclosed herein may selectively perform at least one sterilizing operation according to a preset condition, thereby improving cleanliness of an electric dust collector.

Meanwhile, the embodiments of the disclosure may be implemented in the form of a storage medium for storing instructions to be carried out by a computer. The instructions may be stored in the form of program codes, and when executed by a processor, may generate program modules to perform operation in the embodiments of the disclosure.

The machine-readable storage medium may be provided in the form of a non-transitory storage medium. The term 'non-transitory storage medium' may mean a tangible device without including a signal, e.g., electromagnetic waves, and may not distinguish between storing data in the storage medium semi-permanently and temporarily. For example, the non-transitory storage medium may include a buffer that temporarily stores data.

The aforementioned methods according to the various embodiments of the disclosure may be provided in a computer program product. The computer program product may be a commercial product that may be traded between a seller and a buyer. The computer program product may be distributed in the form of a storage medium (e.g., a compact disc read only memory (CD-ROM)), through an application store (e.g., Play Store™), directly between two user devices (e.g., smart phones), or online (e.g., downloaded or uploaded). In the case of online distribution, at least part of the computer program product (e.g., a downloadable app) may be at least temporarily stored or arbitrarily created in a storage medium that may be readable to a device such as a server of the manufacturer, a server of the application store, or a relay server.

The embodiments of the disclosure have thus far been described with reference to accompanying drawings. It will be obvious to those of ordinary skill in the art that the disclosure may be practiced in other forms than the embodiments as described above without changing the technical idea or essential features of the disclosure. The above embodiments are only by way of example, and should not be construed in a limited sense.

What is claimed is:

1. An air conditioner comprising:

a dust collection sheet to collect particles in air passing through thereof, the dust collection sheet including:

a first electrode; and a second electrode separated from the first electrode and facing the first electrode;

a power supplier electrically connected to the first electrode and the second electrode;

a controller configured to:

control the power supplier to apply a direct current (DC) voltage to the first electrode to perform a dust collecting operation to collect the particles in the air;

perform at least one of:

a first sterilizing operation to heat the first electrode and the second electrode at a first temperature for a first period of time by controlling the power supplier to apply an Alternate Current (AC) voltage to the first electrode and the second electrode; and a second sterilizing operation to heat the first electrode and the second electrode at a second temperature which is higher than the first temperature for a second period of time which is shorter than the first period of time by controlling the power supplier to apply the AC voltage to the first electrode and the second electrode.

2. The air conditioner of claim 1, further comprising a gas sensor configured to measure a degree of contamination of the air having passed through the dust collection sheet, wherein the controller is further configured to perform the second sterilizing operation based on the measured degree of contamination of the air.

3. The air conditioner of claim 2, wherein the controller is further configured to sequentially perform the first sterilizing operation and the second sterilizing operation based on the measured degree of contamination of the air being equal to or greater than a reference degree of contamination.

4. The air conditioner of claim 1, wherein the controller is further configured to count accumulated performance hours of the dust collecting operation, and perform the second sterilizing operation based on the accumulated performance hours reaching reference hours.

5. The air conditioner of claim 4, wherein the controller is further configured to reset the accumulated performance hours of the dust collecting operation based on a performance of the second sterilizing operation.

6. The air conditioner of claim 1, wherein the controller is further configured to perform the second sterilizing operation after performing the first sterilizing operation based on accumulated performance hours of the dust collecting operation reaching the reference hours.

7. The air conditioner of claim 1, further comprising an electrode temperature sensor configured to measure a temperature of at least one of the first electrode and the second electrode, wherein the controller is further configured to control the power supplier to stop applying AC voltage to the first electrode and the second electrode based on the measured temperature reaching a first limit temperature for the first sterilizing operation or a second limit temperature for the second sterilizing operation.

8. The air conditioner of claim 7, wherein the electrode temperature sensor comprises at least one of a first electrode temperature sensor configured to measure a surface temperature of the first electrode and a second electrode temperature sensor configured to measure a surface temperature of the second electrode.

9. The air conditioner of claim 1, wherein the controller is further configured to control the power supplier to apply a first AC voltage having an effective value, which is smaller than a magnitude of the DC voltage, to the first electrode and the second electrode in the first sterilizing operation, and control the power supplier to apply a second AC voltage, having an effective value which is smaller than the magnitude of the DC voltage but higher than the first AC voltage, to the first electrode and the second electrode in the second sterilizing operation.

10. The air conditioner of claim 1, wherein the dust collection sheet comprises a first power connector connected to an end of the first electrode and to which the DC voltage is applied;

a second power connector connected to an end of the second electrode and grounded;

a third power connector connected to an other end of the second electrode and to which a first AC voltage to heat the second electrode at the first temperature or a second AC voltage to heat the second electrode at the second temperature is applied; and a fourth power connector connected to an other end of the first electrode and to which a first AC voltage to heat the first electrode at the first temperature or a second AC voltage to heat the first electrode at the second temperature is applied.

11. The air conditioner of claim 10, wherein the first power connector is arranged on one side of the dust collection sheet in a second direction which is perpendicular to a first direction which is a direction of length of the first electrode, wherein the second power connector is on an other side of the dust collection sheet in the second direction, wherein the third power connector is to be adjacent to the first power connector in the second direction, and wherein the fourth power connector is to be adjacent to the second power connector in the second direction.

12. A method of controlling an air conditioner including a dust collection sheet including a first electrode and a second electrode separated from the first electrode and facing the first electrode, the method comprising:

applying a DC voltage to the first electrode for a dust collecting operation to collect particles in air passing through the dust collection sheet;

performing at least one of:

a first sterilizing operation to heat the first electrode and the second electrode at first temperature for a first period of time by applying an AC voltage to the first electrode and the second electrode; and a second sterilizing operation to heat the first electrode and the second electrode at a second temperature which higher than the first temperature for a second period of time which is shorter than the first period of time by applying the AC voltage to the first electrode and the second electrode.

13. The method of claim 12, wherein the performing of the second sterilizing operation is based on a degree of contamination of the air having passed the dust collection sheet which is measured by a gas sensor of the air conditioner.

14. The method of claim 13, wherein the performing of the first sterilizing operation is based on the measured degree of contamination of the air being smaller than a preset reference degree of contamination.

15. The method of claim 13, wherein the performing of the first sterilizing operation and the second sterilizing operation is sequentially performed based on the measured degree of contamination of the air being equal to or greater than a preset reference degree of contamination.

16. The method of claim 13, further comprising counting accumulated performance hours of the dust collecting operation, and performing the second sterilizing operation based on the accumulated performance hours reaching reference hours.

17. The method of claim 16, further comprising resetting the accumulated performance hours of the dust collecting operation based on a performance of the second sterilizing operation.

18. The method of claim 13, wherein the performing of the second sterilizing operation is performed after performing the first sterilizing operation based on accumulated performance hours reaching a preset reference time.

19. The method of claim 13, further comprising measuring a temperature of at least one of the first electrode and the second electrode, and stopping the applying of the AC voltage to the first electrode and the second electrode based on the measured temperature reaching a first limit temperature for the first sterilizing operation or a second limit temperature for the second sterilizing operation.

20. The method of claim 13, wherein the applying of the AC voltage comprises applying a first AC voltage having an effective value, which is smaller than a magnitude of the DC voltage, to the first electrode and the second electrode in the first sterilizing operation, and applying a second AC voltage, having an effective value which is smaller than the magnitude of the DC voltage but higher than the first AC voltage, to the first electrode and the second electrode in the second sterilizing operation.

* * * * *